US007386109B2

(12) United States Patent
Suzuki et al.

(10) Patent No.: US 7,386,109 B2
(45) Date of Patent: Jun. 10, 2008

(54) COMMUNICATION APPARATUS

(75) Inventors: Ryuji Suzuki, Tokyo (JP); Michie Sato, Tokyo (JP); Ryuichi Tanaka, Kanagawa (JP); Tsutomu Shoji, Kanagawa (JP); Noboru Shuhama, Tokyo (JP)

(73) Assignee: Sony Corporation, Tokyo (JP)

( * ) Notice: Subject to any disclaimer, the term of this patent is extended or adjusted under 35 U.S.C. 154(b) by 729 days.

(21) Appl. No.: 10/902,127

(22) Filed: Jul. 28, 2004

(65) Prior Publication Data

US 2005/0058300 A1 Mar. 17, 2005

(30) Foreign Application Priority Data

Jul. 31, 2003 (JP) ..... 2003-284543

(51) Int. Cl.
*H04M 3/42* (2006.01)

(52) U.S. Cl. ..... 379/202.01

(58) Field of Classification Search ..... 381/104; 379/202.01

See application file for complete search history.

(56) References Cited

U.S. PATENT DOCUMENTS 5,524,059 A * 6/1996 Zurcher ..... 381/92
6,321,080 B1 * 11/2001 Diethorn ..... 455/416
2005/0276423 A1 * 12/2005 Aubauer et al. ..... 381/92

* cited by examiner

*Primary Examiner*—Curtis Kuntz
*Assistant Examiner*—Alexander Jamal
(74) *Attorney, Agent, or Firm*—Frommer Lawrence & Haug LLP; William S. Frommer; Ellen Marcie Emas

(57) ABSTRACT

A communication apparatus used for two-way speech wherein the acoustic couplings between a speaker and microphones can be made equal by a simple method, wherein radially arranged microphones are located at equal distances from a speaker, a test signal generation unit outputs a pink noise signal to the speaker, the signal is input to a microphone detecting the sound of the speaker through variable gain amplifiers, attenuated in variable attenuation units, the peak value of absolute values of differences between the signals of an opposing pair of microphones is detected at level detection units, and a level judgment and gain control unit adjusts the gains of the variable gain amplifiers or attenuation amounts of the variable attenuation units so that the value becomes within a sensitivity difference adjustment error.

12 Claims, 30 Drawing Sheets

WHEN SOUND SOURCE IS IN FRONT OF MICROPHONE

WHEN SOUND SOURCE IS IN THE DIRECTION OF 60 DEGREES FROM THE FRONT OF MICROPHONE

WHEN SOUND SOURCE IS IN THE DIRECTION OF 120 DEGREES FROM THE FRONT OF MICROPHONE

WHEN SOUND SOURCE IS IN THE DIRECTION OF 180 DEGREES FROM THE FRONT OF MICROPHONE

BASIC VIEW OF SPEECH START/END JUDGMENT

SELECTION SWITCH PROCESSING OF MICROPHONE SIGNAL

COMMUNICATION APPARATUS

BACKGROUND OF THE INVENTION

1. Field of the Invention

The present invention relates to an integral microphone and speaker configuration type communication apparatus suitable for use for example when a plurality of conference participants in two conference rooms hold a conference by voice. More particularly, the present invention relates to an integral microphone and speaker configuration type communication apparatus where the communication apparatus is used for equalizing acoustic couplings of a speaker and a plurality of microphones.

2. Description of the Related Art

A TV conference system has been used to enable conference participants in two conference rooms at distant locations to hold a conference. A TV conference system captures images of the conference participants in the conference rooms by imaging means, picks up their voices by microphones, sends the images captured by the imaging means and the voices picked up by the microphones through a communication channel, displays the captured images on display units of television receivers of the conference rooms of the other parties, and outputs the picked up voices from speakers.

In such a TV conference system, there is the problem that in each conference room, it is difficult to pick up the voices of the speaking parties at positions distant from the imaging means and the microphones. As a means for dealing with this, sometimes a microphone is provided for each conference participant. Further, there is also the problem that the voices output from the speakers of the television receivers are hard for conference participants at positions distant from the speakers to hear.

Japanese Unexamined Patent Publication (Kokai) No. 2003-87887 and Japanese Unexamined Patent Publication (Kokai) No. 2003-87890 disclose, in addition to a usual TV conference system providing video and audio for TV conferences in conference rooms at distant locations, a voice input/output system integrally configured by microphones and speakers having the advantages that the voices of conference participants in the conference rooms of the other parties can be clearly heard from the speakers and there is little effect from noise in the individual conference rooms or the load of echo cancellers is light.

For example, the voice input/output system disclosed in Japanese Unexamined Patent Publication (Kokai) No. 2003-87887, as described by referring to FIG. 5 to FIG. 8, FIG. 9, and FIG. 23 of that publication, is structured, from the bottom to the top, by a speaker box 5 having a built-in speaker 6, a conical reflection plate 4 radially opening upward for diffusing sound, a sound blocking plate 3, and a plurality of single directivity microphones (four in FIG. 6 and FIG. 7 and six in FIG. 23) supported by poles 8 in a horizontal plane radially at equal angles. The sound blocking plate 3 is for blocking sound from the lower speaker 5 from entering the plurality of microphones.

The voice input/output system disclosed in Japanese Unexamined Patent Publication (Kokai) Nos. 2003-87887 and 2003-87890 is utilized as means for supplementing a TV conference system for providing video and audio. As a remote conference system, however, often a complex apparatus such as a TV conference system does not have to be used: voice alone is sufficient. For example, when a plurality of conference participants hold a conference between a head office and a distant sales office of the same company, since everyone knows what everyone looks like and understands who is speaking by their voices, the conference can be sufficiently held, without the video of a TV conference system, just like speaking by phone. Further, when introducing a TV conference system, there are the disadvantages such as the large investment for introducing the TV conference system per se, the complexity of the operation, and the large communication costs for transmitting the captured video.

If assuming the case of application to such a conference using only audio, the voice input/output system disclosed in Japanese Unexamined Patent Publication (Kokai) No. 2003-87887 and Japanese Unexamined Patent Publication (Kokai) No. 2003-87890 can be improved in many ways from the viewpoint of the performance, the viewpoint of the price, the viewpoint of the dimensions, and the viewpoints of suitability with the usage environment, user-friendliness, etc.

SUMMARY OF THE INVENTION

An object of the present invention is to provide a communication apparatus further improved from the viewpoint of performance as means used for only speech, the viewpoint of price, the viewpoint of dimensions, and the viewpoints of suitability with the usage environment, user-friendliness, etc.

Another object of the present invention is to provide such an improved communication apparatus equalizing acoustic couplings between the speaker and a plurality of microphones by a simple method.

According to a first aspect of the present invention, there is provided an integral microphone and speaker configuration type communication apparatus comprising a speaker, at least one pair of microphones having directivity and arranged on a straight line straddling a center axis of the speaker arranged around the center axis of said speaker radially at equal angles and at equal distances from the speaker, an amplifying means for independently amplifying sound picked up by the microphones and able to adjust the gain, a level detecting means for calculating an absolute value of a difference of a pair of microphones among output signals of the amplifying means and holding a peak value of the calculated values, a level judging/gain controlling means, and a test signal generating means, the test signal generating means outputting a pink noise signal to the speaker, and the level judging/gain controlling means adjusting the gain of the amplifying means so that the difference of signals of a pair of microphones detected by the level detecting means becomes within a predetermined sensitivity difference adjustment error when the microphones detect the sound of the speaker outputting a sound in accordance with the pink noise.

According to a second aspect of the present invention, there is provided an integral microphone and speaker configuration type communication apparatus comprising a speaker, at least one pair of microphones having directivity and arranged on a straight line straddling a center axis of the speaker arranged around the center axis of said speaker radially at equal angles and at equal distances from the speaker, an amplifying means for amplifying sound picked up by the microphones, an attenuating means for independently attenuating sound signals amplified by the amplifying means, a level detecting means for calculating an absolute value of difference of signals of a pair of microphones among output signals of the attenuating means and holding the peak value of the calculated values, a level judging/gain controlling means, and a test signal generating means, the test signal generating means outputting a pink noise signal to the speaker, and the level judging/gain controlling means adjusting the attenuation amount of the attenuating means so that the difference of signals of a pair of microphones detected by the level detecting means becomes within a predetermined sensitivity difference adjustment error when the microphones detect the sound of the speaker outputting a sound in accordance with the pink noise.

According to a third aspect of the present invention, there is provided an integral microphone and speaker configuration type communication apparatus comprising a speaker, at least one pair of microphones having directivity and arranged on a straight line straddling a center axis of the speaker arranged around the center axis of said speaker radially at equal angles and at equal distances from the speaker, an amplifying means for independently amplifying sounds picked up by the microphones and able to adjust their gain, an attenuating means for independently attenuating sound signals amplified by the amplifying means, a level detecting means for calculating an absolute value of the difference of signals of a pair of microphones among output signals of the attenuating means and holding the peak value of the calculated values, a level judging/gain controlling means, and a test signal generating means, the test signal generating means outputting a pink noise signal to the speaker, and the level judging/gain controlling means adjusting the gain of the amplifying means and/or the attenuation amount of the attenuating means so that the difference of signals of a pair of microphones detected by the level detecting means becomes within a predetermined sensitivity difference adjustment error when the microphones detect the sound of the speaker outputting a sound in accordance with the pink noise.

Preferably, the attenuating means, the level detecting means, and the level judging/gain controlling means are integrally configured by a digital signal processor, and the attenuation amount of the attenuating means is set digitally by the level judging/gain controlling means.

When the gain of the amplifying means cannot be adjusted digitally, the level judging/gain controlling means adjusts the attenuation amount of the attenuating means. Further, when the gain of the amplifying means can be adjusted digitally and a control width thereof is smaller than the sensitivity difference adjustment error, the level judging/gain controlling means adjusts the gain of the amplifying means. Further, when the gain of the amplifying means can be adjusted digitally and the control width thereof is larger than the sensitivity difference adjustment error, the level judging/gain controlling means adjusts the gain of the amplifying means in a possible range and then adjusts the attenuation amount of the attenuating means. Alternatively, when the gain of the amplifying means can be adjusted digitally together with the detection signal of a pair of microphones and the control width thereof is smaller than the sensitivity difference adjustment error, the level judging/gain controlling means adjusts the gain of the amplifying means for the detection signals of a pair of microphones in the possible range and then independently adjusts the attenuation amount of the attenuating means or performs the inverse processing to the former.

Alternatively, when the gain of the amplifying means can be adjusted digitally together with the detection signal of a pair of microphones and the control width thereof is larger than the sensitivity difference adjustment error, the level judging/gain controlling means adjusts a higher attenuation amount of the attenuating means between detection signals of the microphones and then adjusts the gain of the amplifying means for the detection signals of a pair of microphones, and further adjusts the higher attenuation amount of the attenuating means between the detection signals of the microphones.

In the present invention, by just using the integral microphone and speaker configuration type communication apparatus, the acoustic couplings between the speaker and the one or more pairs of microphones can be made equal. Namely, in the present invention, by just using the integral microphone and speaker configuration type communication apparatus, in other words, without providing a special apparatus, the sensitivity difference of a pair of microphones can be adjusted, and the acoustic couplings with a plurality of microphones can be made equal. In this way, in any situation with the integral microphone and speaker configuration type communication apparatus of the present invention, the acoustic couplings can be made equal without using any special apparatus.

Further, in the present invention, the situations where the gain can be adjusted in the amplifying means and the attenuation amount in the attenuating means are suitably selected in accordance with the gain adjustment situation of the amplifying means to make the acoustic couplings between the speaker and the microphones equal.

BRIEF DESCRIPTION OF THE DRAWINGS

These and other objects and features of the present invention will become clearer from the following description of the preferred embodiments given with reference to the accompanying drawings, in which.

DESCRIPTION OF THE PREFERRED EMBODIMENTS

Figure 1A:
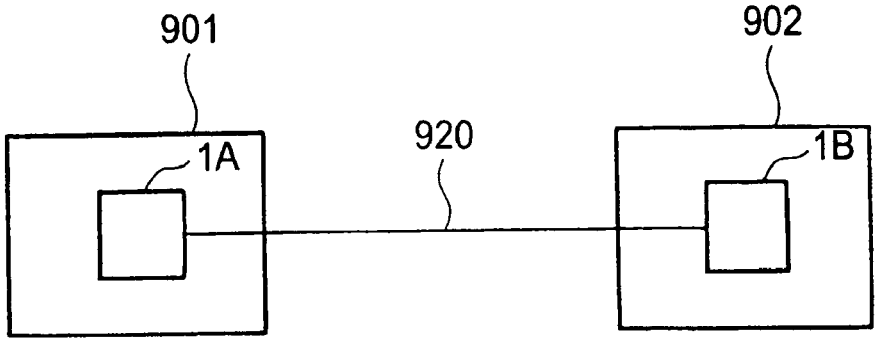
FIG. 1A is a view schematically showing a conference system as an example to which an integral microphone and speaker configuration type communication apparatus (communication apparatus) of the present invention is applied.
Figure 1B:
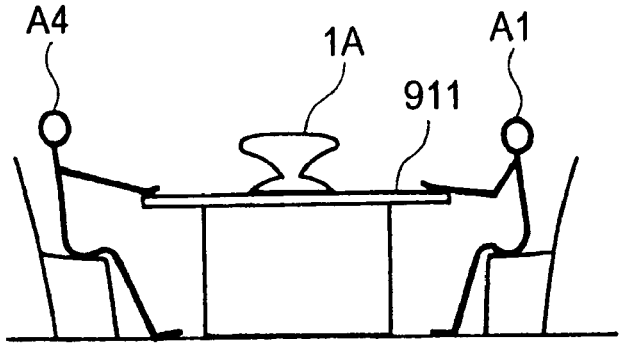
FIG. 1B is a view of a state where the communication apparatus in FIG. 1A is placed.
Figure 1C:
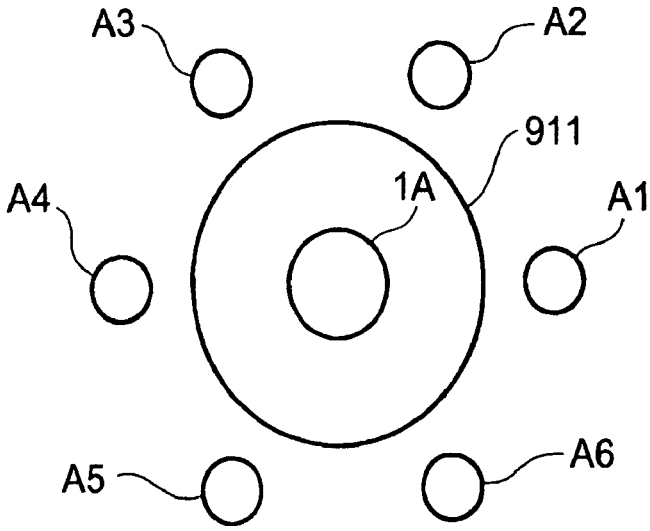
FIG. 1C is a view of an arrangement of the communication apparatus placed on a table and conference participants.

First, an example of the application of the integral microphone and speaker configuration type communication apparatus (hereinafter referred to as the "communication apparatus") of the present invention will be explained. FIGS. 1A to 1C are views of the configuration showing an example to which the communication apparatus of the present invention is applied. As illustrated in FIG. 1A, communication apparatuses 1A and 1B are disposed in two conference rooms 901 and 902 at distant locations. These communication apparatuses 1A and 1B are connected by a telephone line 920. As illustrated in FIG. 1B, in the two conference rooms 901 and 902, the communication apparatuses 1A and 1B are placed on tables 911 and 912. Note, that in FIG. 1B, for simplification of the illustration, only the communication apparatus 1A in the conference room 901 is illustrated. The communication apparatus 1B in the conference room 902 is the same however. A perspective view of the outer appearance of the communication apparatuses 1A and 1B is given in FIG. 2. As illustrated in FIG. 1C, a plurality of (six in the present embodiment) conference participants A1 to A6 are positioned around each of the communication apparatuses 1A and 1B. Note that in FIG. 1C, for simplification of the illustration, only the conference participants around the communication apparatus 1A in the conference room 901 are illustrated. The arrangement of the conference participants located around the communication apparatus 1B in the other conference room 902 is the same however.

The communication apparatus of the present invention enables questions and answers by voice between for example the two conference rooms 901 and 902 via the telephone line 920. Usually, a conversation via the telephone line 920 is carried out between one speaker and another, that is, one-to-one, but in the communication apparatus of the present invention, a plurality of conference participants A1 to A6 can converse with each other by using one telephone line 920. Note that although details will be explained later, in order to avoid congestion of audio, the parties speaking at the same time (same time period) are limited to one at each side. The communication apparatus of the present invention covers audio (speech), so only transmits audio via the telephone line 920. In other words, a large amount of image data is not transmitted as in a TV conference system. Further, the communication apparatus of the present invention compresses the speech of the conference participants for transmission, so the transmission load of the telephone line 920 is light.

Configuration of Communication Apparatus

Figure 2:
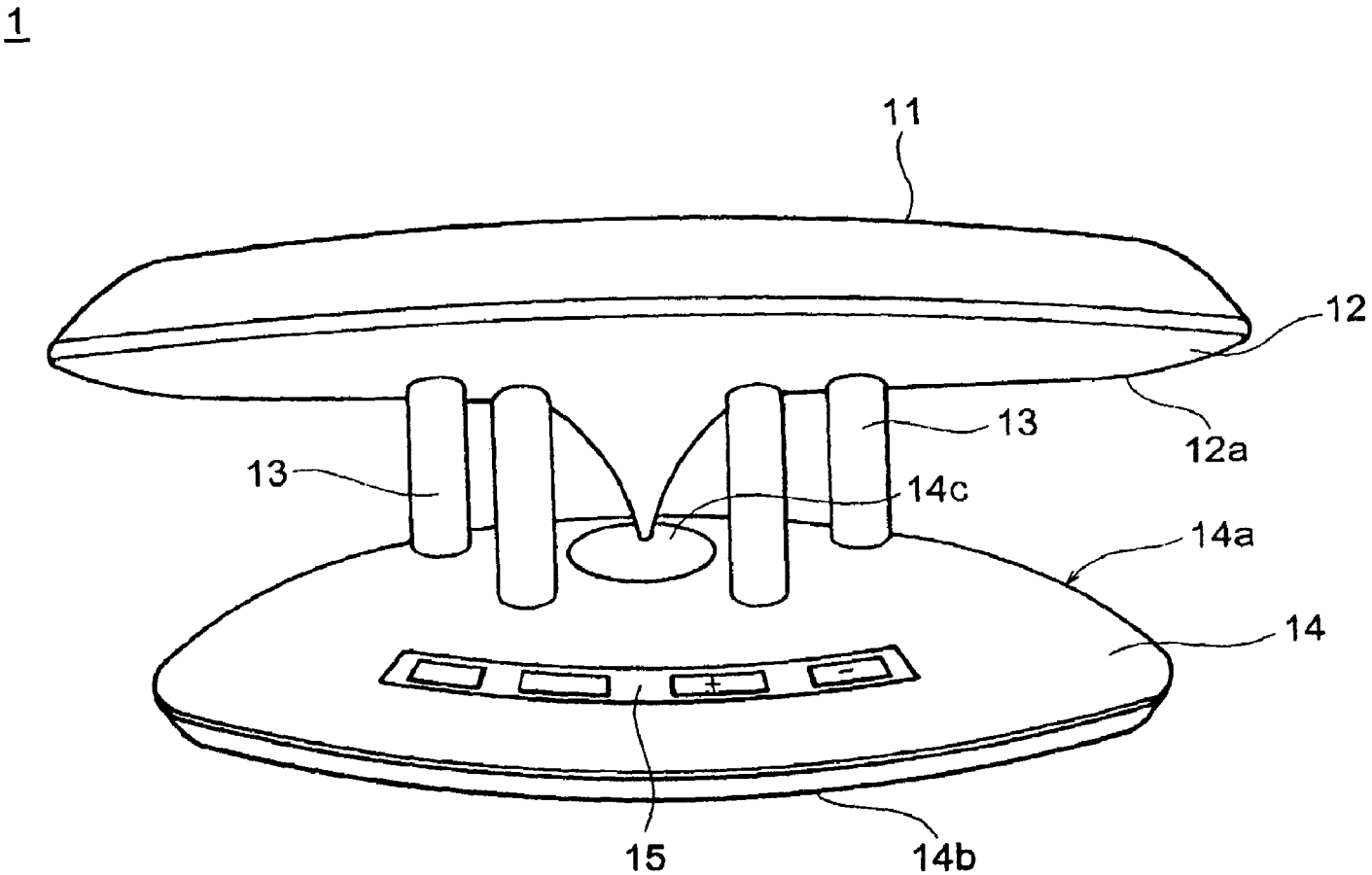
FIG. 2 is a perspective view of the communication apparatus of an embodiment of the present invention.
Figure 3:
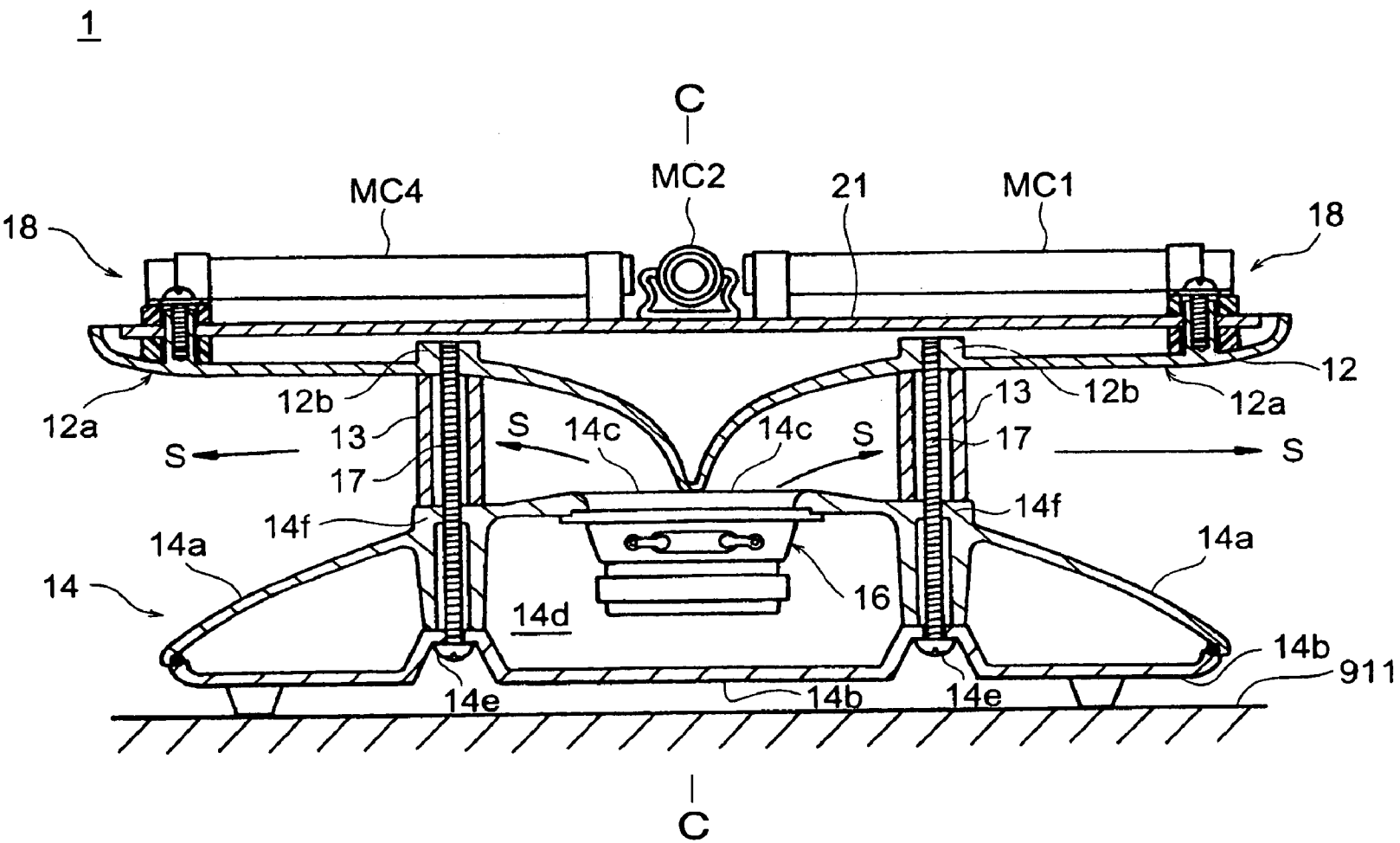
FIG. 3 is a sectional view of the inside of the communication apparatus illustrated in FIG. 1.
Figure 4:
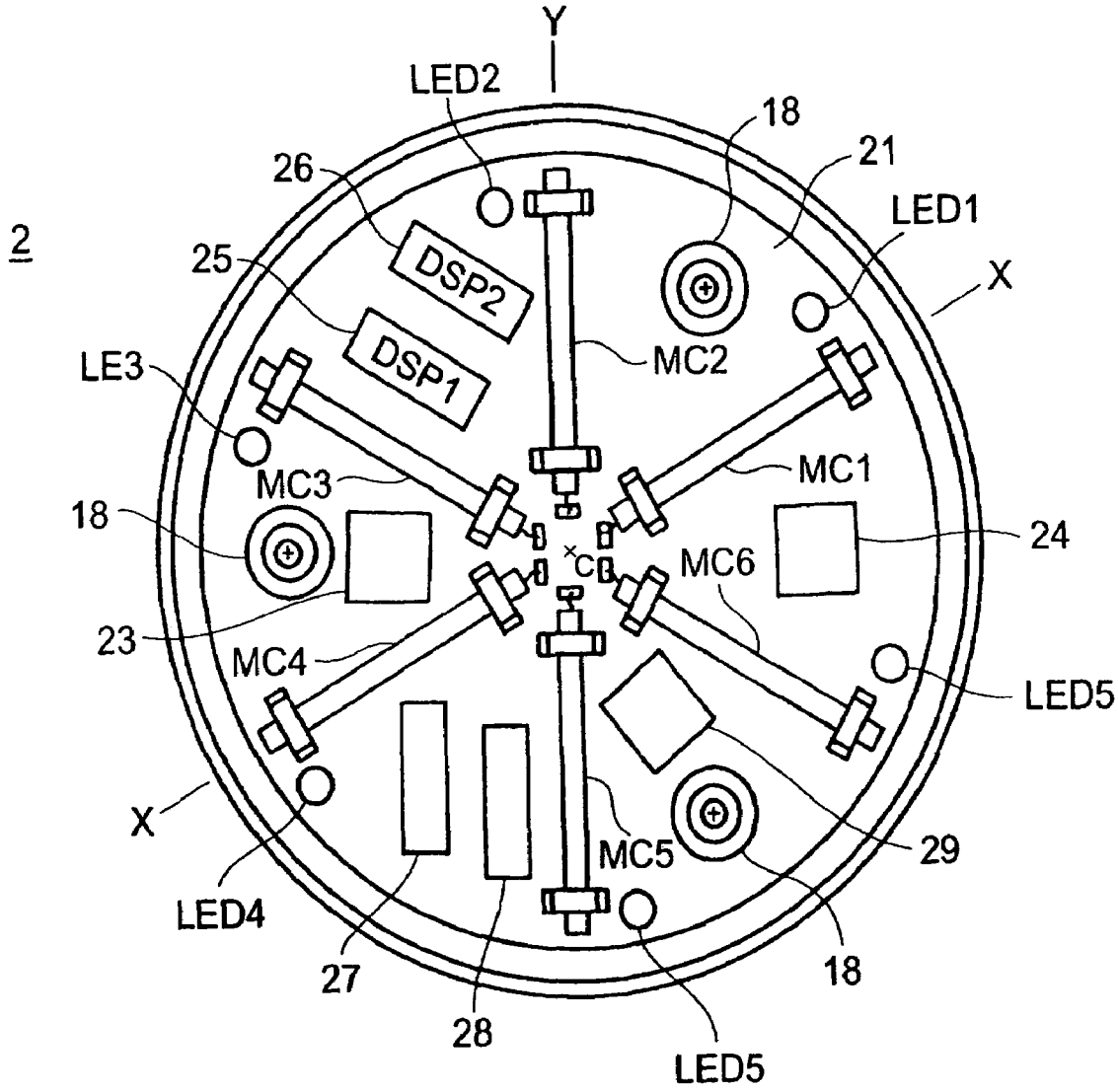
FIG. 4 is a plan view of a microphone electronic circuit housing with the upper cover detached in the communication apparatus illustrated in FIG. 1.

The configuration of the communication apparatus according to an embodiment of the present invention will be explained first referring to FIG. 2 to FIG. 4. FIG. 2 is a perspective view of the communication apparatus according to an embodiment of the present invention. FIG. 3 is a sectional view of the communication apparatus illustrated in FIG. 2. FIG. 4 is a plan view of a microphone electronic circuit housing of the communication apparatus illustrated in FIG. 1 and a plan view along a line X-X-Y of FIG. 3.

As illustrated in FIG. 2, the communication apparatus 1 has an upper cover 11, a sound reflection plate 12, a coupling member 13, a speaker housing 14, and an operation unit 15. As illustrated in FIG. 3, the speaker housing 14 has a sound reflection surface 14*a*, a bottom surface 14*b*, and an upper sound output opening 14*c*. A receiving and reproduction speaker 16 is housed in a space surrounded by the sound reflection surface 14*a* and the bottom surface 14*b*, that is, an inner cavity 14*d*. The sound reflection plate 12 is located above the speaker housing 14. The speaker housing 14 and the sound reflection plate 12 are connected by the coupling member 13.

A restraint member 17 passes through the coupling member 13. The restraint member 17 restrains the space between a restraint member bottom fixing portion 14*e* of the bottom surface 14*b* of the speaker housing 14 and a restraint member fixing portion 12*b* of the sound reflection plate 12. Note that the restraint member 17 only passes through a restraint member passage 14*f* of the speaker housing 14. The reason why the restraint member 17 passes through the restraint member passage 14*f* and does not restrain it is that the speaker housing 14 vibrates by the operation of the speaker 16 and that the vibration thereof is not restricted around the upper sound output opening 14*c*.

Speaker

Speech by a speaking party of the other conference room passes through the receiving and reproduction speaker 16 and upper sound output opening 14*c* and is diffused along the space defined by the sound reflection surface 12*a* of the sound reflection plate 12 and the sound reflection surface

14*a* of the speaker housing 14 to the entire 360 degree orientation around an axis C-C. The cross-section of the sound reflection surface 12*a* of the sound reflection plate 12 draws a loose trumpet type arc as illustrated. The cross-section of the sound reflection surface 12*a* forms the illustrated sectional shape over 360 degrees (entire orientation) around the axis C-C. Similarly, the cross-section of the sound reflection surface 14*a* of the speaker housing 14 draws a loose convex shape as illustrated. The cross-section of the sound reflection surface 14*a* forms the illustrated sectional shape over 360 degrees (entire orientation) around the axis C-C.

The sound S output from the receiving and reproduction speaker 16 passes through the upper sound output opening 14*c*, passes through the sound output space defined by the sound reflection surface 12*a* and the sound reflection surface 14*a* and having a trumpet-like cross-section, is diffused along the surface of the table 911 on which the communication apparatus 1 is placed in the entire orientation of 360 degrees around the axis C-C, and is heard with an equal volume by all conference participants A1 to A6. In the present embodiment, the surface of the table 911 is utilized as part of the sound propagating means. The state of diffusion of the sound S output from the receiving and reproduction speaker 16 is shown by the arrows.

The sound reflection plate 12 supports a printed circuit board 21. The printed circuit board 21, as illustrated planarly in FIG. 4, mounts the microphones MC1 to MC6 of the microphone electronic circuit housing 2, light emitting diodes LEDs 1 to 6, a microprocessor 23, a codec 24, a first digital signal processor (DSP) 25, a second digital signal processor (DSP) 26, an A/D converter block 27, a D/A converter block 28, an amplifier block 29, and other various types of electronic circuits. The sound reflection plate 12 also functions as a member for supporting the microphone electronic circuit housing 2.

The printed circuit board 21 has dampers 18 attached to it for absorbing vibration from the receiving and reproduction speaker 16 so as to prevent vibration from the receiving and reproduction speaker 16 from being transmitted through the sound reflection plate 12, entering the microphones MC1 to MC6 etc., and becoming noise. Each damper 18 is comprised by a screw and a buffer material such as a vibration-absorbing rubber insert between the screw and the printed circuit board 21. The buffer material is fastened by the screw to the printed circuit board 21. Namely, the vibration transmitted from the receiving and reproduction speaker 16 to the printed circuit board 21 is absorbed by the buffer material. Due to this, the microphones MC1 to MC6 are not affected much by sound from the speaker 16.

Arrangement of Microphones

As illustrated in FIG. 4, six microphones MC1 to MC6 are located radially at equal angles (at intervals of 60 degrees in the present embodiment) from the center axis C of the printed circuit board 21. Each microphone is a microphone having single directivity. The characteristics thereof will be explained later. Each of the microphones MC1 to MC6 is supported by a first microphone support member 22*a* and a second microphone support member 22*b* both having flexibility or resiliency so that it can freely rock (illustration is made for only the first and second microphone support members 22*a* and 22*b* of the microphone MC1 for simplifying the illustration). In addition to the measure of preventing the influence of vibration from the receiving and reproduction speaker 16 by the dampers 18 using the above buffer materials, by preventing the influence of vibration from the receiving and reproduction speaker 16 by absorbing the vibration of the printed circuit board 21 vibrating by the vibration from the receiving and reproduction speaker 16 by the first and second microphone support members 22*a* and 22*b* having flexibility or resiliency, noise of the receiving and reproduction speaker 16 is avoided.

As illustrated in FIG. 3, the receiving and reproduction speaker 16 is oriented vertically with respect to the center axis C-C of the plane in which the microphones MC1 to MC6 are located (oriented (directed) upward in the present embodiment). By such an arrangement of the receiving and reproduction speaker 16 and the six microphones MC1 to MC6, the distances between the receiving and reproduction speaker 16 and the microphones MC1 to MC6 become equal and the audio from the receiving and reproduction speaker 16 arrives at the microphones MC1 to MC6 with almost the same volume and same phase. However, due to the configuration of the sound reflection surface 12*a* of the sound reflection plate 12 and the sound reflection surface 14*a* of the speaker housing 14, the sound of the receiving and reproduction speaker 16 is prevented from being directly input to the microphones MC1 to MC6. In addition, as explained above, by using the dampers 18 using the buffer materials and the first and second microphone support members 22*a* and 22*b* having flexibility or resiliency, the influence of the vibration of the receiving and reproduction speaker 16 is reduced. The conference participants A1 to A6, as illustrated in FIG. 1C, are usually positioned at almost equal intervals in the 360 degree direction of the communication apparatus 1 in the vicinity of the microphones MC1 to MC6 arranged at intervals of 60 degrees.

Light Emission Diodes

As an example of the means for notification of the determination of the speaking party explained later (microphone selection result displaying means 30), light emission diodes LED1 to LED6 are arranged in the vicinity of the microphones MC1 to MC6. The light emission diodes LED1 to LED6 have to be provided so as to be able be viewed from all conference participants A1 to A6 even in a state where the upper cover 11 is attached. Accordingly, the upper cover 11 is provided with a transparent window so that the light emission states of the light emission diodes LED1 to LED6 can be viewed. Naturally openings can also be provided at the portions of the light emission diodes LED1 to LED6 in the upper cover 11, but the transparent window is preferred from the viewpoint for preventing dust from entering the microphone electronic circuit housing 2.

In order to perform the various types of signal processing explained later, the printed circuit board 21 is provided with a first digital processor (DSP) 25, a second digital signal processor (DSP) 26, and various types of electronic circuits 27 to 29 are arranged in a space other than the portion where the microphones MC1 to MC6 are located. In the present embodiment, the DSP 25 is used as the signal processing means for performing processing such as filter processing and microphone selection processing together with the various types of electronic circuits 27 to 29, and the DSP 26 is used as an echo canceller.

Figure 5:
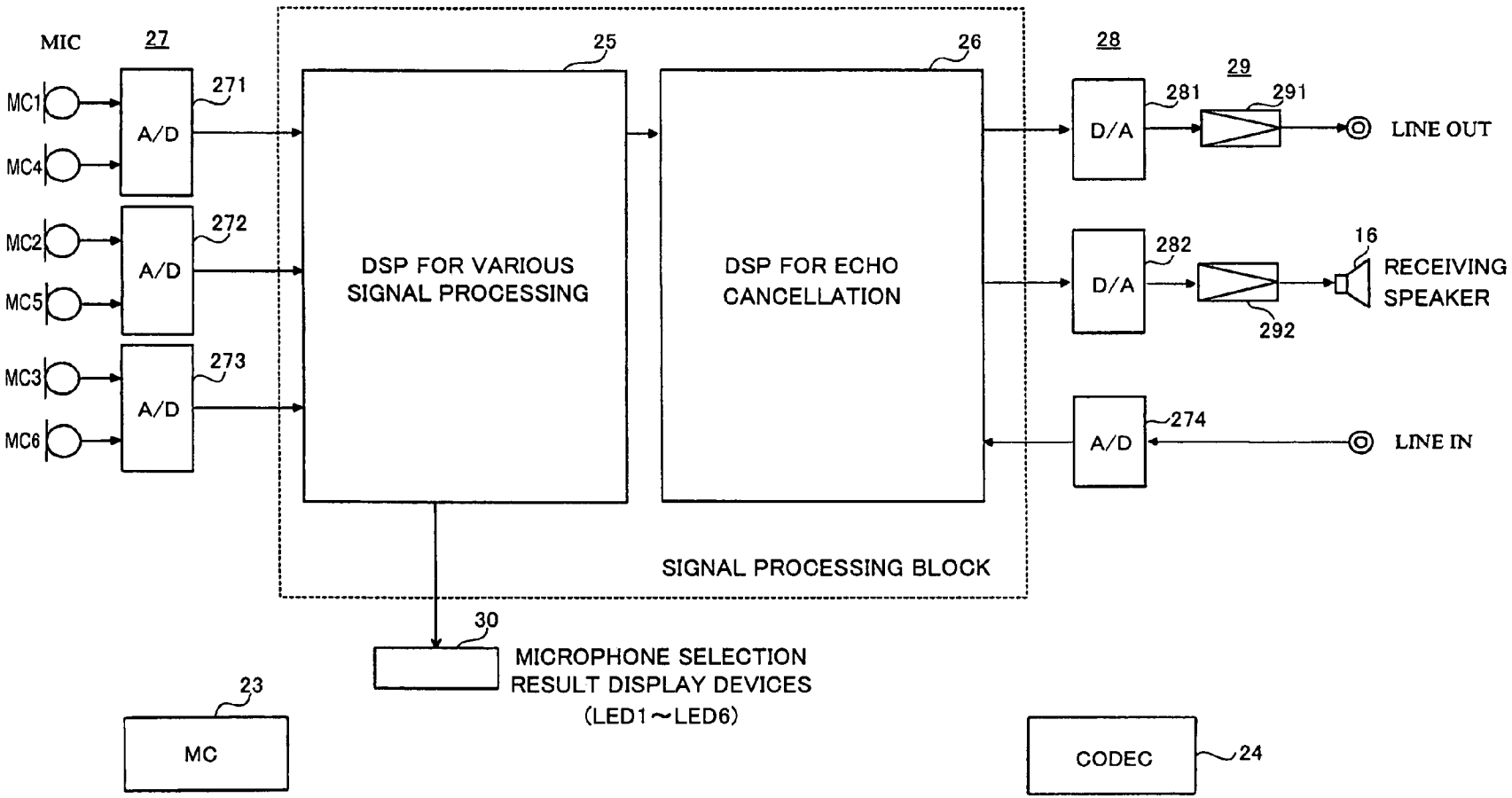
FIG. 5 is a view of a connection configuration of principal circuits of the microphone electronic circuit housing and shows the connection configuration of a first digital signal processor and a second digital signal processor.

FIG. 5 is a view of the schematic configuration of a microprocessor 23, a codec 24, the DSP 25, the DSP 26, an A/D converter block 27, a D/A converter block 28, an amplifier block 29, and other various types of electronic circuits. The microprocessor 23 performs the processing for overall control of the microphone electronic circuit housing 2. The codec 24 compresses and encodes the audio to be transmitted to the conference room of the other party. The DSP 25 performs the various types of signal processing explained below, for example, the filter processing and the microphone selection processing. The DSP 26 functions as the echo canceller and has an echo cancellation transmitter 261 and an echo cancellation receiver 262. In FIG. 5, as an example of the A/D converter block 27, four A/D converters 271 to 274 are exemplified, as an example of the D/A converter block 28, two D/A converters 281 and 282 are exemplified, and as an example of the amplifier block 29, two amplifiers 291 and 292 are exemplified. In addition, as the microphone electronic circuit housing 2, various types of circuits such as the power supply circuit are mounted on the printed circuit board 21.

In FIG. 4, pairs of microphones MC1-MC4, MC2-MC5, and MC3-MC6 each arranged on a straight line at positions symmetric (or opposite.) with respect to the center axis C of the printed circuit board 21 input two channels of analog signals to the A/D converters 271 to 273 for converting analog signals to digital signals. In the present embodiment, one A/D converter converts two channels of analog input signals to digital signals. Therefore, detection signals of two (a pair of) microphones located on a straight line straddling the center axis C, for example, the microphones MC1 and MC4, are input to one A/D converter and converted to the digital signals. Further, in the present embodiment, in order to identify the speaking party of the audio transmitted to the conference room of the other party, the difference of audio of two microphones located on one straight line, the magnitude of the audio, etc. are referred to. Therefore when signals of two microphones located on a straight line are input to the same A/D converter, the conversion timings become almost the same. There are therefore the advantages that the timing error is small when finding the difference of audio outputs of the two microphones, the signal processing becomes easy, etc. Note that the A/D converters 271 to 274 can be configured as A/D converters 271 to 274 equipped with variable gain type amplification functions as well. Sound pickup signals of the microphones MC1 to MC6 converted at the A/D converters 271 to 273 are input to the DSP 25 where various types of signal processing explained later are carried out. As one of processing results of the DSP 25, the result of selection of one of the microphones MC1 to MC6 is output to corresponding light emission diode among the diodes LED1 to LED6—examples of the microphone selection result displaying means 30.

The processing result of the DSP 25 is output to the DSP 26 where the echo cancellation processing is carried out. The DSP 26 has for example an echo cancellation transmitter 261 and an echo cancellation receiver 262. The processing results of the DSP 26 are converted to analog signals at the D/A converters 281 and 282. The output from the D/A converter 281 is encoded at the codec 24 according to need, output to a line-out terminal of the telephone line 920 (FIG. 1A) via the amplifier 291, and output as sound via the receiving and reproduction speaker 16 of the communication apparatus 1 disposed in the conference room of the other party. The audio from the communication apparatus 1 disposed in the conference room of the other party is input via the line-in terminal of the telephone line 920 (FIG. 1A), converted to a digital signal at the A/D converter 274, and input to the DSP 26 where it is used for the echo cancellation processing. Further, the audio from the communication apparatus 1 disposed in the conference room of the other party is applied to the speaker 16 by a not illustrated route and output as sound. The output from the D/A converter 282 is output as sound from the receiving and reproduction speaker 16 of the communication apparatus 1 via the amplifier 292. Namely, the conference participants A1 to A6 can also hear audio emitted by the speaking parties in the conference room via the receiving and reproduction speaker 16 in addition to the audio of the selected speaking party of the conference room of the other party from the receiving and reproduction speaker 16 explained above.

Microphones MC1 to MC6

Figure 6:
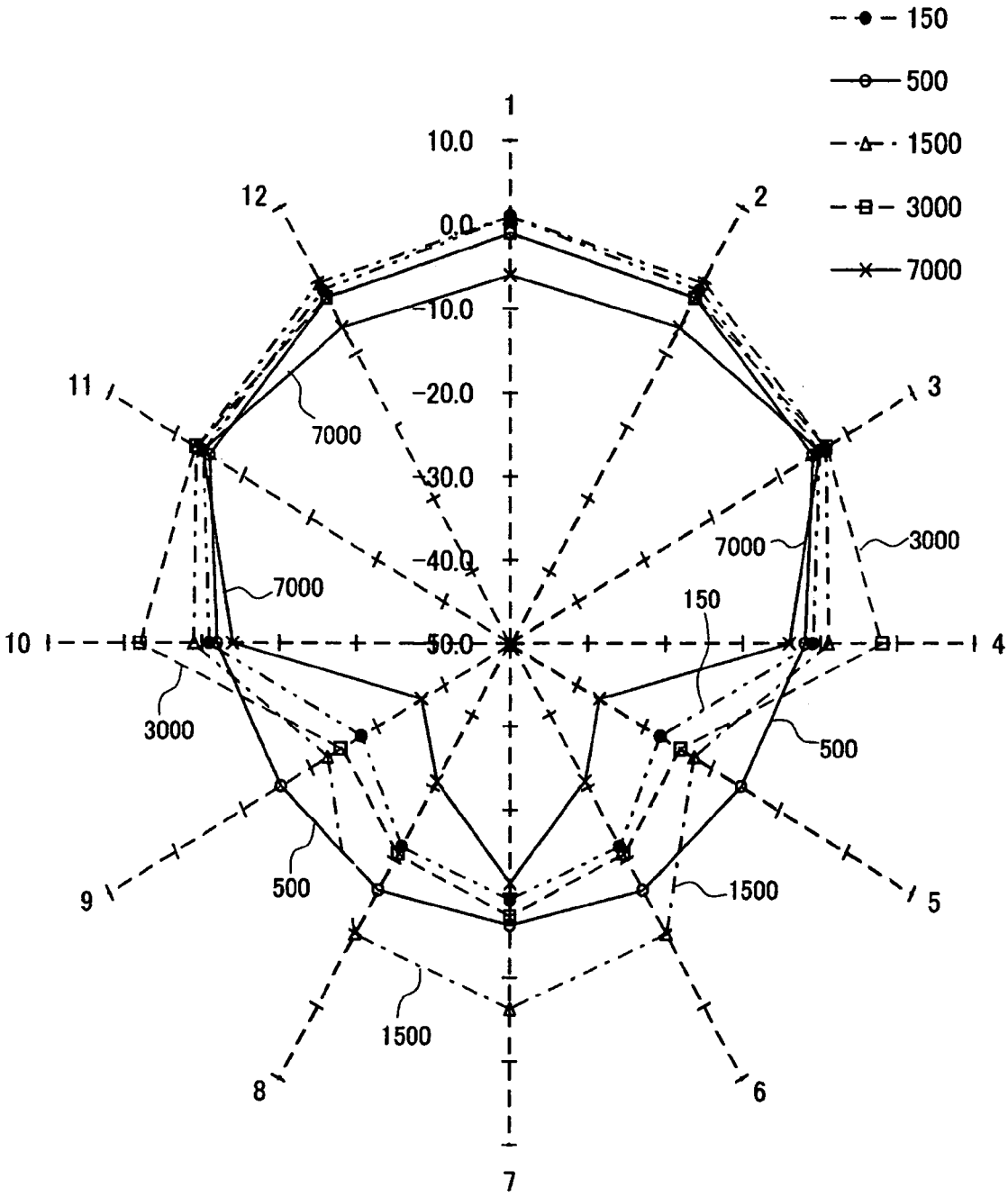
FIG. 6 is a view of the characteristics of the microphones illustrated in FIG. 4.

FIG. 6 is a graph showing characteristics of the microphones MC1 to MC6. In each single directivity characteristic microphone, as illustrated in FIG. 6, the frequency characteristic and the level characteristic differ according to the angle of arrival of the audio at the microphone from the speaking party. The plurality of curves indicate directivities when frequencies of the sound pickup signals are 100 Hz, 150 Hz, 200 Hz, 300 Hz, 400 Hz, 500 Hz, 700 Hz, 1000 Hz, 1500 Hz, 2000 Hz, 3000 Hz, 4000 Hz, 5000 Hz, and 7000 Hz. Note that for simplifying the illustration, FIG. 6 illustrates the directivity for 150 Hz, 500 Hz, 1500 Hz, 3000 Hz, and 7000 Hz as representative examples.

FIGS. 7A to 7D are graphs showing spectrum analysis results for the position of the sound source and the sound pickup levels of the microphones and, as an example of the analysis, show results obtained by positioning the speaker a predetermined distance from the communication apparatus 1, for example, a distance of 1.5 meters, and applying fast fourier transforms (FFT) to the audio picked up by the microphones at constant time intervals. The X-axis represents the frequency, the Y-axis represents the signal level, and the Z-axis represents the time. When using microphones having directivity of FIG. 6, a strong directivity is shown at the front surfaces of the microphones. In the present embodiment, by making good use of such a characteristic, the DSP 25 performs the selection processing of the microphones.

When not having microphones having directivity as in the present invention, but using microphones having no directivity, all sounds around the microphones are picked up, therefore the S/N's of the audio of the speaking party with the surrounding noise are mixed, so a good sound can not be picked up so much. In order to avoid this, in the present invention, by picking up the sounds by one directivity microphones, the S/N with the surrounding noise is enhanced. As the method for obtaining the directivity of the microphones, a microphone array using a plurality of no directivity microphones can be used. With this method, however, complex processing is required for matching the time axes (phases) of the plurality of signals, therefore a long time is taken, the response is low, and the hardware configuration becomes complex. Namely, complex signal processing is required also for the signal processing system of the DSP. The present invention solves such a problem by using microphones having directivity exemplified in FIG. 6. To combine microphone array signals to utilize microphones as directivity sound pickup microphones, there is the disadvantage that the outer shape is restricted by the pass frequency characteristic and the outer shape becomes large. The present invention also solves this problem.

Effect of Hardware Configuration of Communication Apparatus

The communication apparatus having the above configuration has the following advantages.

(1) The positional relationships between the even number of microphones MC1 to MC6 arranged at equal angles radially and at equal intervals and the receiving and reproduction speaker 16 are constant and further the distances thereof are very close, therefore the level of the sound issued from the receiving and reproduction speaker 16 directly coming back is overwhelmingly larger and dominant than the level of the sound issued from the receiving and reproduction speaker 16 passing through the conference room (room) environment and coming back to the microphones MC1 to MC6. Due to this, the characteristics (signal levels (intensities), frequency characteristics (f characteristics), and phases) of arrival of the sounds from the speaker 16 to the microphones MC1 to MC6 are always the same. That is, the communication apparatus 1 in the embodiment of the present invention has the advantage that the transmission function is always the same.

(2) Therefore, there is the advantage that the transmission function when switching the output of the microphone transmitted to the conference room of the other party when the speaking party changes does not change and it is not necessary to adjust the gain of the microphone system whenever the microphone is switched. In other words, there is the advantage that it is not necessary to re-do the adjustment once adjustment is carried out at the time of manufacture of the communication apparatus.

(3) Even if switching the microphone when the speaking party changes for the same reason as above, a single echo canceller (DSP) 26 is sufficient. A DSP is expensive. Further, it is not necessary to arrange a plurality of DSPs on a printed circuit board 21 on which various members are mounted and having little empty space. Also, the space for arranging the DSP on the printed circuit board 21 may be small. As a result, the printed circuit board 21 and, in turn, the communication apparatus of the present invention can be made small in size.

(4) As explained above, since the transmission functions between the receiving and reproduction speaker 16 and the microphones MC1 to MC6 are constant, there is the advantage for example that adjustment of the sensitivity difference of the microphones of ±3 dB can be carried out solely by the microphone unit of the communication apparatus. Details of the adjustment of the sensitivity difference will be explained later.

(5) As the table on which the communication apparatus 1 is mounted, usually use is made of a round table or a polygonal table. A speaker system for equally dispersing (scattering) audio having an equal quality in the entire orientation of 360 degrees about the axis C by one receiving and reproduction speaker 16 in the communication apparatus 1 becomes possible.

(6) There is the advantage that the sound output from the receiving and reproduction speaker 16 is propagated through the table surface of the round table (boundary effect) and good quality sound effectively arrives at the conference participants equally and with a good efficiency, the sound and the phase of opposite side are cancelled in a ceiling direction of the conference room and become small, there is a little reflected sound from the ceiling direction at the conference participants, and as a result a clear sound is distributed to the participants.

(7) The sound output from the receiving and reproduction speaker 16 arrives at the microphones MC1 to MC6 arranged at equal angles radially and at equal intervals with the same volume simultaneously, therefore a decision of whether sound is audio of a speaking party or received audio becomes easy. As a result, erroneous decision in the microphone selection processing is reduced. Details thereof will be explained later.

(8) By arranging an even number of, for example, six, microphones at equal angles radially and at equal intervals so that a facing pair of microphones are arranged on a straight line, the level comparison for detecting the sound source, for example, the direction of the speaking party, can be easily carried out.

(9) By the dampers 18, the microphone support members 22 etc., the influence of vibration due to the sound of the receiving and reproduction speaker 16 exerted upon the sound pickup of the microphones MC1 to MC6 can be reduced.

(10) As illustrated in FIG. 3, structurally, the degree of direct propagation of the sound of the receiving and reproduction speaker 16 to the microphones MC1 to MC6 is small. Accordingly, in the communication apparatus 1, there is little influence of the noise from the receiving and reproduction speaker 16.

Modification

Figure 8:
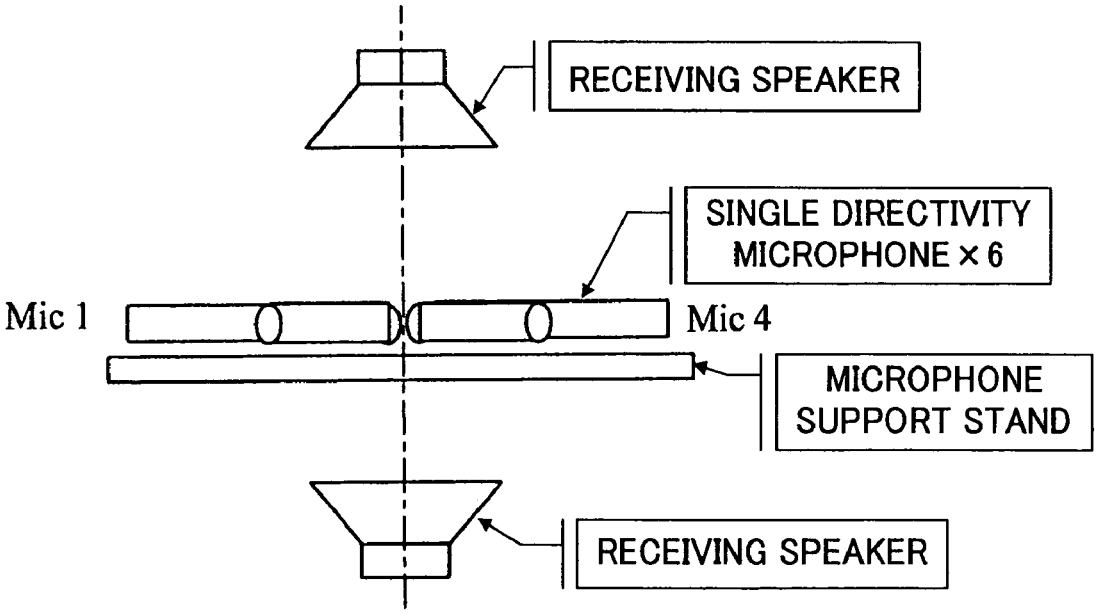
FIG. 8 is a view of the partial configuration of a modification of the communication apparatus of the present invention.

In the communication apparatus 1 explained referring to FIG. 2 to FIG. 3, the receiving and reproduction speaker 16 was arranged at the lower portion, and the microphones MC1 to MC6 (and related electronic circuits) were arranged at the upper portion, but it is also possible to vertically invert the positions of the receiving and reproduction speaker 16 and the microphones MC1 to MC6 (and related electronic circuits) as illustrated in FIG. 8. Even in such a case, the above effects are exhibited.

The number of microphones is not limited to six. Any number of microphones, for example, four or eight, may be arranged at equal angles radially and at equal intervals about the axis C so that a plurality of pairs are located on straight lines (in the same direction), for example, like the microphones MC1 and MC4. The reason that two microphones, for example MC1 and MC4, are arranged on a straight line facing each other is for easily and correctly identifying the speaking party.

Content of Signal Processing

Below, the content of the processing performed mainly by the first digital signal processor (DSP) 25 will be explained.

Figure 9:
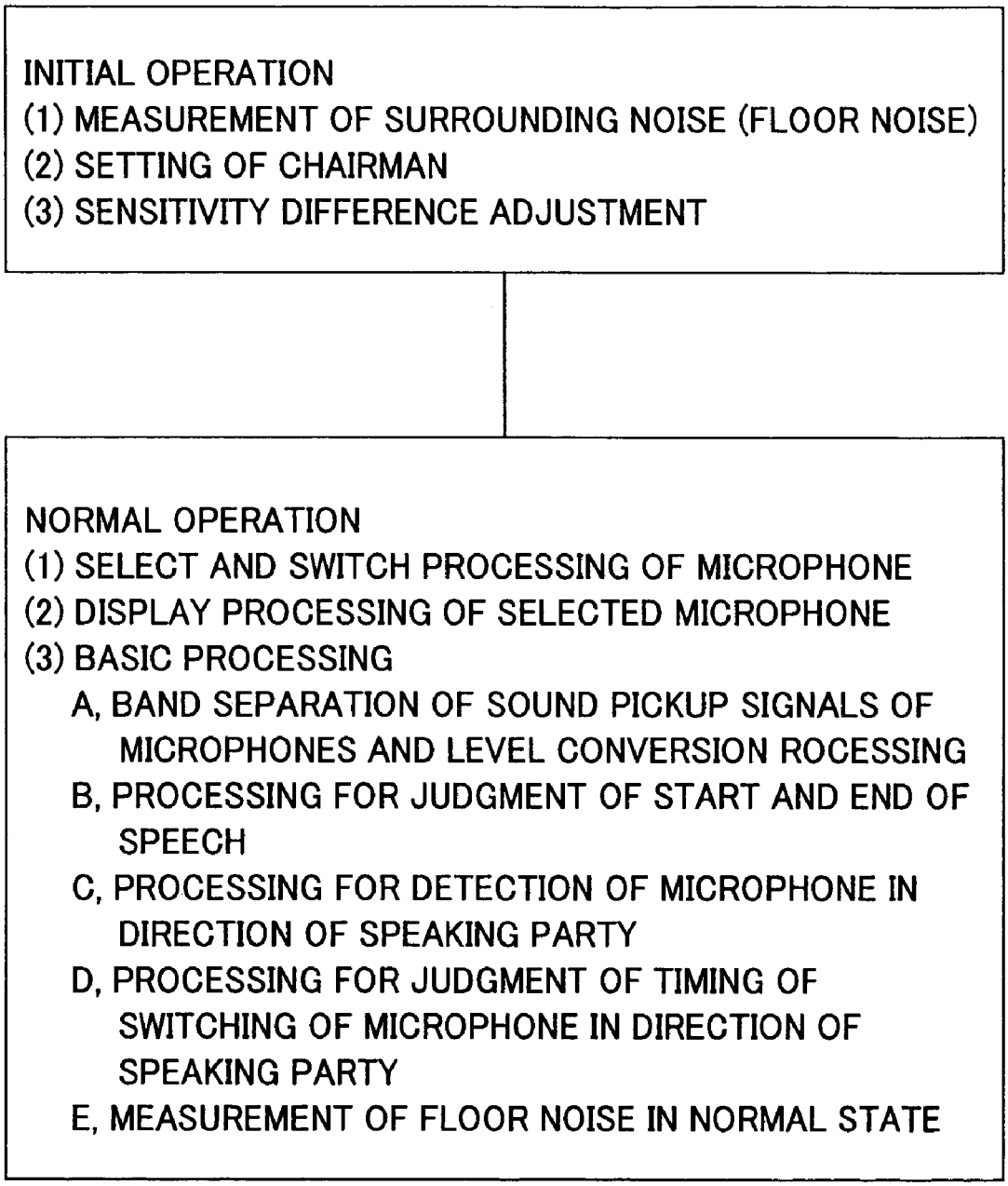
FIG. 9 is a chart schematically showing the overall content of processing in the first digital signal processor.

FIG. 9 is a view schematically illustrating the processing performed by the DSP 25. Below, a brief explanation will be given.

(1) Measurement of Surrounding Noise

As an initial operation, preferably, the noise of the surroundings where the two-way communication apparatus 1 is disposed is measured. The communication apparatus 1 can be used in various environments (conference rooms). In order to achieve correct selection of the microphone and raise the performance of the communication apparatus 1, in the present invention, at the initial stage, the noise of the surrounding environment where the communication apparatus 1 is disposed is measured to enable elimination of the influence of that noise from the signals picked up at the microphones. Naturally, when the communication apparatus 1 is repeatedly used in the same conference room, the noise is measured in advance, so this processing can be omitted when the state of the noise does not change. Note that the noise can also be measured in the normal state. Details of the noise measurement will be explained later.

(2) Selection of Chairman

For example, when using the communication apparatus 1 for a two-way conference, it is advantageous if there is a chairman who runs the proceedings in the conference rooms. Accordingly, as an aspect of the present invention, in the initial stage using the communication apparatus 1, the chairman is set from the operation unit 15 of the communication apparatus 1. As a method for setting the chairman, for example the first microphone MC1 located in the vicinity of the operation unit 15 is used as the chairman's microphone. Naturally, the chairman's microphone may be any microphone. Note that when the chairman repeatedly using the communication apparatus 1 is the same, this processing can be omitted. Alternatively, the microphone at the position where the chairman sits may be determined in advance too. In this case, no operation for selection of the chairman is necessary each time. Naturally, the selection of the chairman is not limited to the initial state and can be carried out at any time. Details of the selection of the chairman will be explained later.

(3) Adjustment of Sensitivity Difference of Microphones

As the initial operation, preferably the gain of the amplification unit for amplifying signals of the microphones MC1 to MC6 or the attenuation value of the attenuation unit is automatically adjusted so that the acoustic couplings between the receiving and reproduction speaker 16 and the microphones MC1 to MC6 become equal. The adjustment of the sensitivity difference will be explained later.

As the usual processing, various types of processings exemplified below are carried out.

(4) Processing for Selection and Switching of Microphones

When a plurality of conference participants simultaneously speak in one conference room, the audio is mixed and hard to understand by the conference participants A1 to A6 in the conference room of the other party. Therefore, in the present invention, in principle, only one person is allowed to speak in a certain time interval. For this, the DSP 25 performs processing for identifying the speaking party and then selecting and switching the microphone for which speech is permitted. As a result, only the speech from the selected microphone is transmitted to the communication apparatus 1 of the conference room of the other party via the telephone line 920 and output from the speaker. Naturally, as explained by referring to FIG. 5, the LED in the vicinity of the microphone of the selected speaking party turns on. The audio of the selected speaking party can be heard from the speaker of the communication apparatus 1 of that room as well so that it can be recognized who is the permitted speaking party. Due to this processing, the signal of the single directivity microphone facing to the speaking party is selected, so a signal having a good S/N can be sent to the other party as the transmission signal.

(5) Display of Selected Microphone

Whether a microphone of the speaking party is selected and which is the microphone of the conference participant permitted to speak is made easy to recognize by all of the conference participants A1 to A6 by turning on the corresponding microphone selection result displaying means 30, for example, light emission diodes LED1 to LED6.

(6) Signal Processing

As a background art of the above microphone selection processing or in order to correctly execute the processing for the microphone selection, various types of signal processing exemplified below are carried out.

(a) Processing for band separation and level conversion of sound pickup signals of microphones (b) Processing for judgment of start and end of speech For use as a trigger for start of judgment for selection of the signal of the microphone facing the direction of the speaking party (c) Processing for detection of the microphone in the direction of the speaking party For analyzing the sound pickup signals of microphones and judging the microphone used by the speaking party (d) Processing for judgment of timing of switching of the microphone in the direction of the speaking party and processing for switching the selection of the signal of the microphone facing the detected speaking party For instructing switching to the microphone selected from the above processing results (e) Measurement of floor noise at the time of normal operation Measurement of Floor (Environment) Noise This processing is divided into initial processing immediately after turning on the power of the two-way communication apparatus and the normal processing. Note that the processing is carried out under the following typical preconditions.

(1) Condition: Measurement time and threshold provisional value:

1. Test tone sound pressure: −40 dB in terms of microphone signal level
2. Noise measurement unit time: 10 seconds
3. Noise measurement in normal state:

Calculation of mean value by measurement results of 10 seconds further repeated 10 times to find the mean value deemed as the noise level.

(2) Standard and threshold value of valid distance by difference between floor noise and speech start reference level 1. 26 dB or more: 3 meters or more
   Detection level threshold value of start of speech: Floor noise level +9 dB
   Detection level threshold value of end of speech: Floor noise level +6 dB
2. 20 to 26 dB: Not more than 3 meters
   Detection level threshold value of start of speech: Floor noise level +9 dB
   Detection level threshold value of end of speech: Floor noise level +6 dB
3. 14 to 20 dB: Not more than 1.5 meters
   Detection level threshold value of start of speech: Floor noise level +9 dB
   Detection level threshold value of end of speech: Floor noise level +6 dB
4. 9 to 14 dB: Not more than 1 meter
   Difference between floor noise level and speech start reference level ÷2+2 dB
   Detection level threshold value of end of speech: speech start threshold value −3 dB
5. 9 dB or less: Slightly hard, several tens centimeters
   Detection level threshold value of start of speech:
6. Difference between floor noise level and speech start reference level ÷2
   Detection level threshold value of end of speech: −3 dB
7. Same or minus: Cannot be judged, selection prohibited (3) The noise measurement start threshold value of the normal processing is started from when the level of the floor noise +3 dB when turning on the power supply is obtained.

Figure 10:
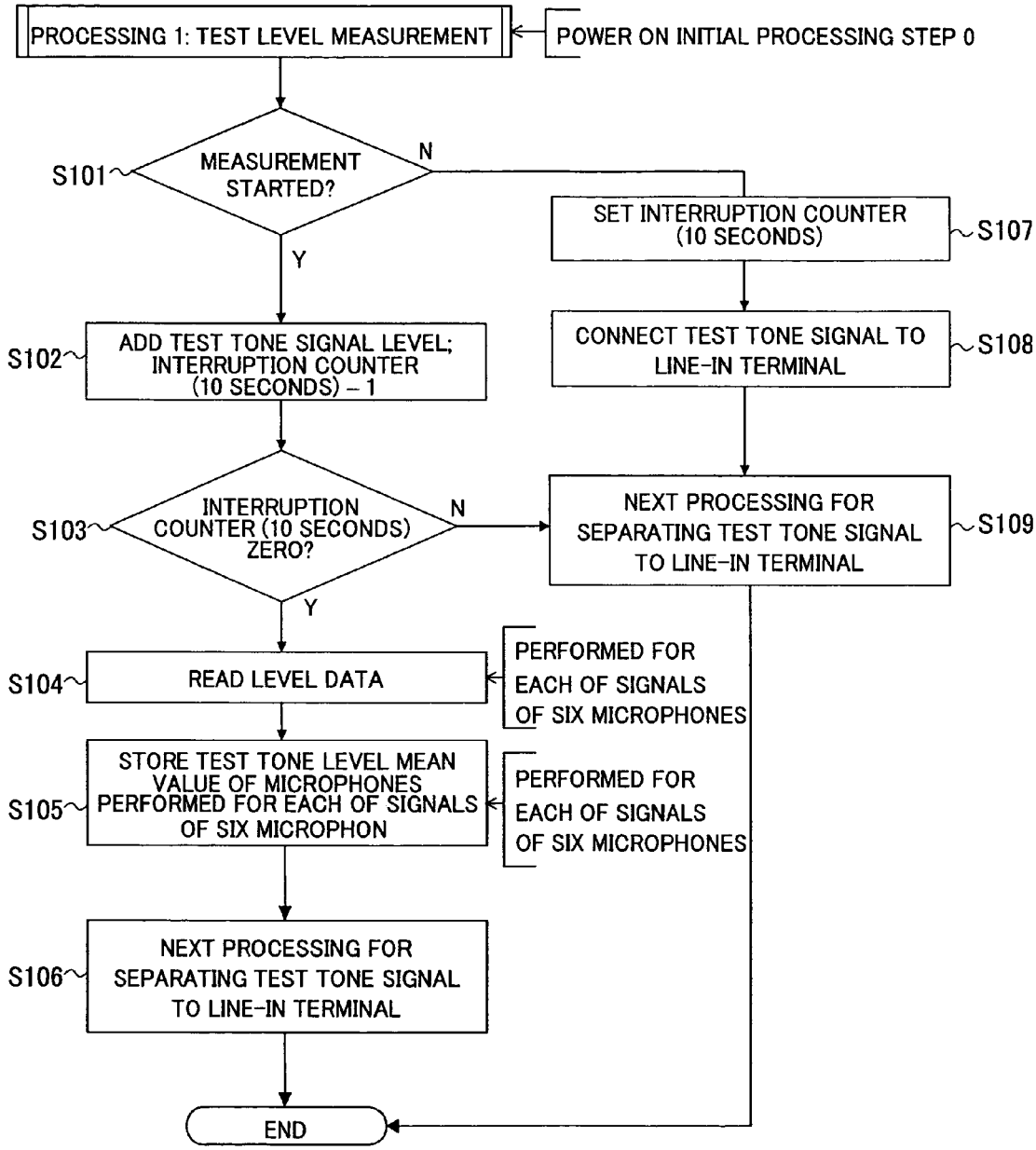
FIG. 10 is a flow chart of a first aspect of a noise measurement method in the present invention.
Figure 11:
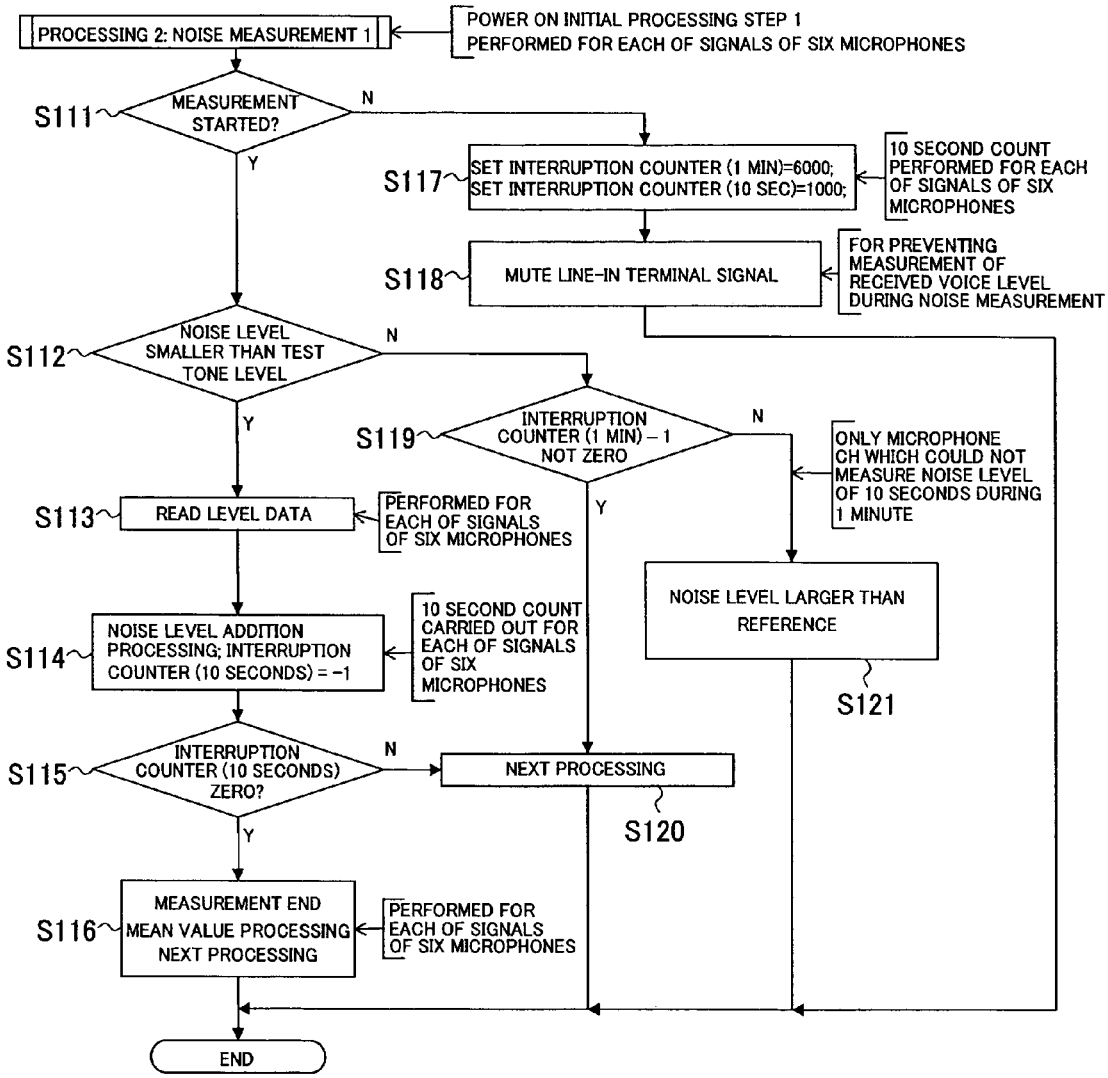
FIG. 11 is a flow chart of a second aspect of the noise measurement method in the present invention.
Figure 12:
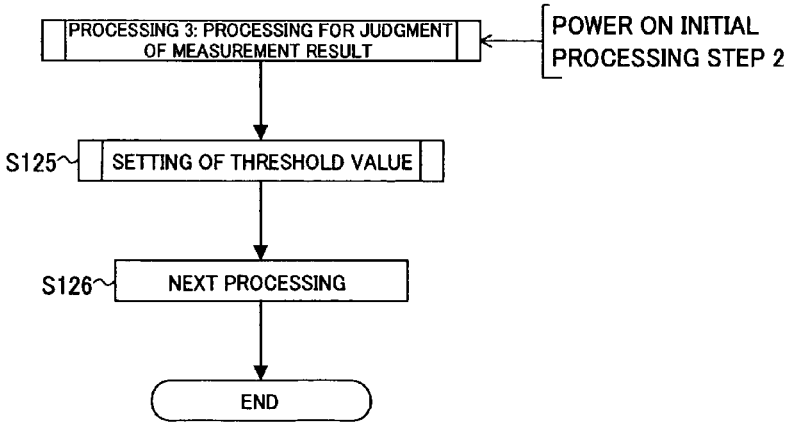
FIG. 12 is a flow chart of a third aspect of the noise measurement method in the present invention.

Immediately after turning on the power of the communication apparatus 1, the DSP 25 performs the following noise measurement explained by referring to FIG. 10 to FIG. 12. The initial processing of the DSP 25 immediately after turning on the power of the communication apparatus 1 is carried out in order to measure the floor noise and the reference signal level and to set the standard of the valid distance between the speaking party and the present system and the speech start and end judgment threshold value levels based on the difference. The level value peak held by the sound pressure level detection unit in the DSP 25 is read out at constant time intervals, for example 10 msec, to calculate the mean value of the values of the unit time which is then deemed as the floor noise. Then, the DSP 25 determines the threshold values of the detection level of the start of the speech and the detection level of the end of the speech based on the measured floor noise level.

FIG. 10, processing 1: Test Level Measurement

The DSP 25 outputs a test tone to the line-in terminal of the reception signal system illustrated in FIG. 5, picks up the sound from the receiving and reproduction speaker 16 at the microphones MC1 to MC6, and uses the signal as the speech start reference level to find the mean value according to the processing illustrated in FIG. 10.

FIG. 11, Processing 2: Noise Measurement 1

The DSP 25 collects the levels of the sound pickup signals from the microphones MC1 to MC6 for a constant time as the floor noise level and finds the mean value according to the processing illustrated in FIG. 11.

FIG. 12, Processing 3: Trial Calculation of Valid Distance

The DSP 25 compares the speech start reference level and the floor noise level, estimates the noise level of the room such as the conference room in which the communication apparatus 1 is disposed, and calculates the valid distance between the speaking party and the communication apparatus 1 with which the communication apparatus 1 works well according to the processing illustrated in FIG. 12.

Judgment of Prohibition of Microphone Selection

Note that when the result of the processing 3 is that the floor noise is larger (higher) than the speech start reference level, the DSP 25 judges that there is a strong noise source in the direction of the microphone, sets the automatic selection state of the microphone in that direction to "prohibit", and displays that on for example the microphone selection result displaying means 30 or the operation unit 15.

Determination of Threshold Value

Figure 13:
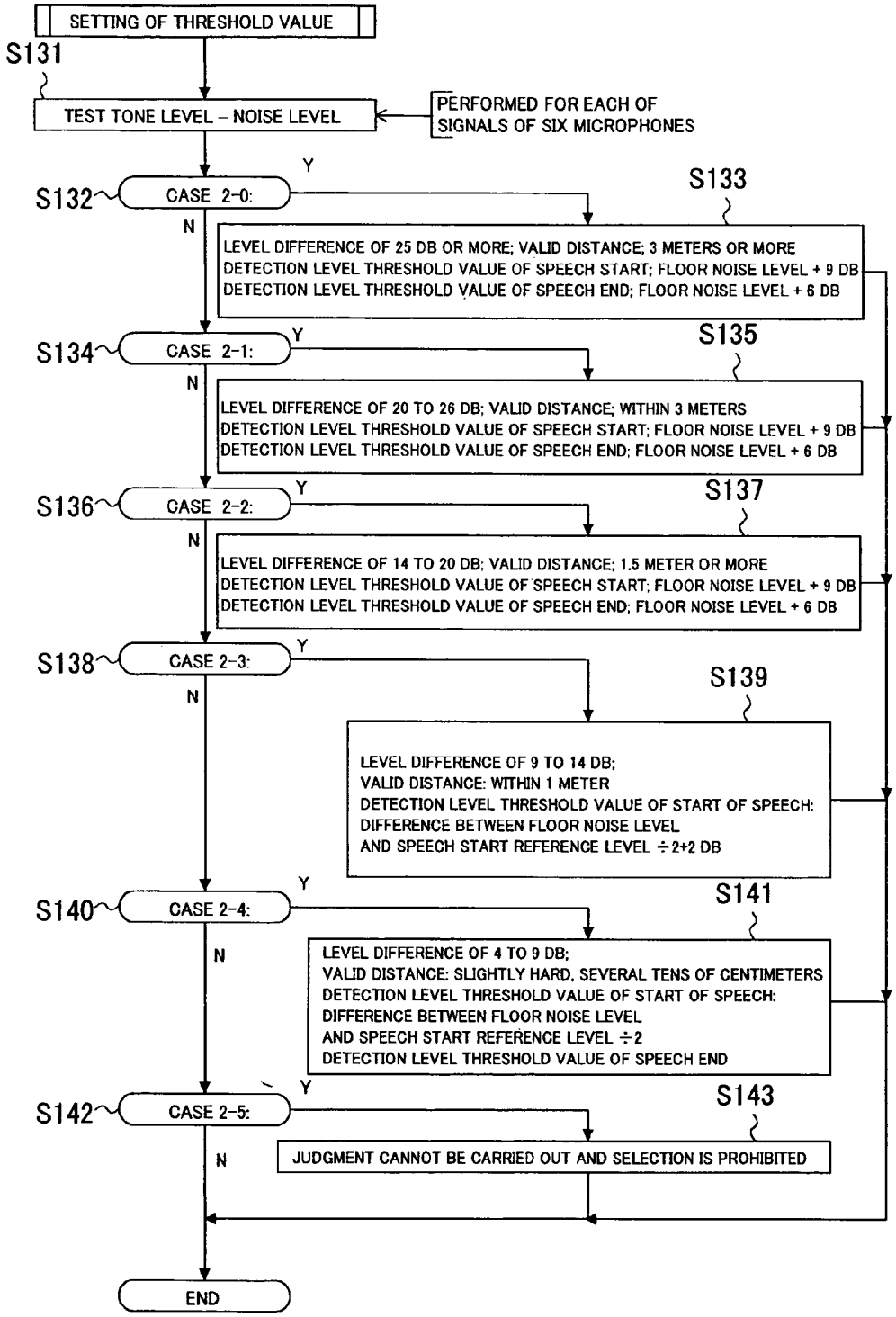
FIG. 13 is a flow chart of a fourth aspect of the noise measurement method in the present invention.

The DSP 25 compares the speech start reference level and the floor noise level as illustrated in FIG. 13 and determines the threshold values of the speech start and end levels from the difference.

Concerning the noise measurement, the next processing is the normal processing, so the DSP 25 sets each timer (counter) and prepares for the next processing.

Normal Noise Processing

Figure 14:
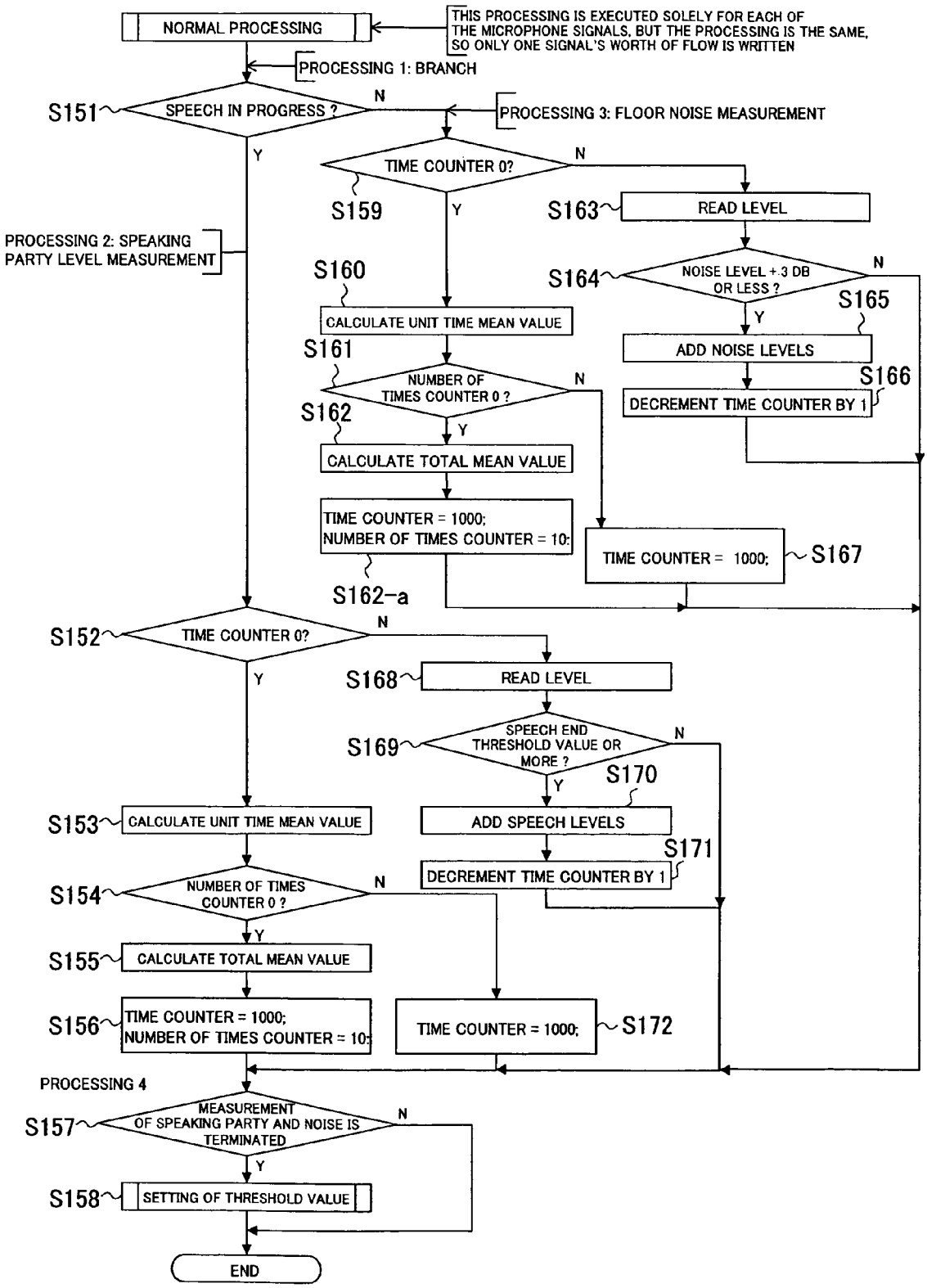
FIG. 14 is a flow chart of a fifth aspect of the noise measurement method in the present invention.

The DSP 25 performs the noise processing according to the processing shown in FIG. 14 in the normal operation state even after the above noise measurement at the initial operation of the communication apparatus 1, measures the mean value of the volume level of the speaking party selected for each of six microphones MC1 to MC6 and the noise level after detecting the end of speech and resets the speech start and end judgment threshold value levels in units of constant times.

FIG. 14, Processing 1

The DSP 25 determines branching to the processing 2 or the processing 3 by deciding whether speech is in progress or speech has ended.

FIG. 14, Processing 2: Speaking Party Level Measurement

The DSP 25 averages the level data in a unit time, for example, 10 seconds, during speech a plurality of times, for example 10 times, and records the same as the speaking party level. When the speech is ended in the unit time, the time count and the speech level measurement are suspended until the start of new speech. After detecting new speech, the measurement processing is restarted.

FIG. 14, Processing 3: Floor Noise Measurement 2

The DSP 25 averages the noise level data of the unit time from when the end of speech is detected to when speech is started, for example, an amount of 10 seconds, a plurality of times, for example, 10 times, and records the same as the floor noise level. When there is new speech in the unit time, the DSP 25 suspends the time count and noise measurement in the middle and, after detecting the end of the new speech, restarts the measurement processing.

FIG. 14, Processing 4: Threshold Value Determination 2

The DSP 25 compares the speech level and the floor noise level and determines the threshold values of the speech start and end levels from the difference.

Note that the mean value of the speech level of a speaking party is found for use for other than the above, therefore it is also possible to set the speech start and end detection threshold levels unique to the speaking party facing a microphone.

Generation of Various Types of Frequency Component Signals by Filter Processing

Figure 15:
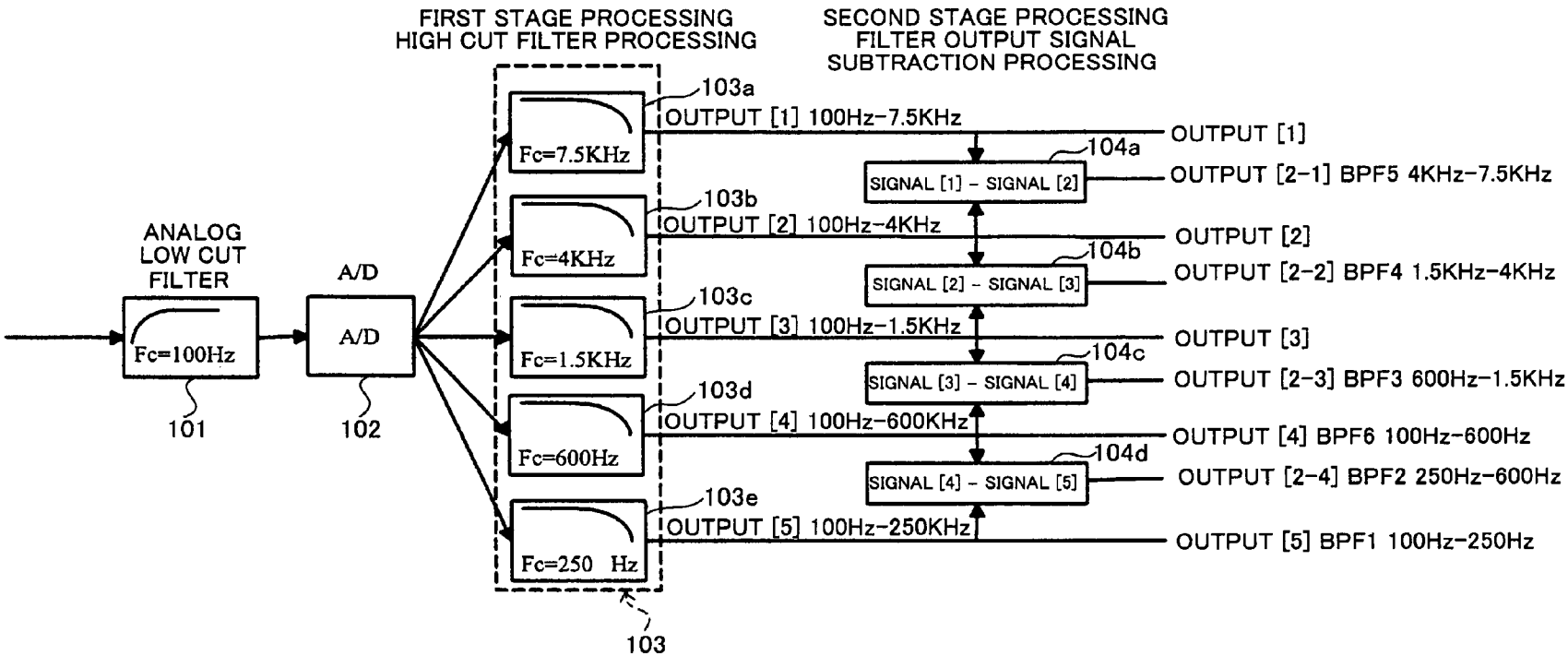
FIG. 15 is a view of filter processing in the communication apparatus of the present invention.

FIG. 15 is a view of the configuration showing the filter processing performed at the DSP 25 using the sound signals picked up by the microphones as pre-processing. FIG. 15 shows the processing for one microphone (channel (one sound pickup signal)).

The sound pickup signals of microphones are processed at an analog low cut filter 101 having a cut-off frequency of for example 100 Hz, the filtered voice signals from which the frequency of 100 Hz or less was removed are output to the A/D converter 102, and the sound pickup signals converted to the digital signals at the A/D converter 102 are stripped of their high frequency components at the digital high cut filters 103*a* to 103*e* (referred to overall as 103) having cut-off frequencies of 7.5 kHz, 4 kHz, 1.5 kHz, 600 Hz, and 250 Hz (high cut processing). The results of the digital high cut filters 103*a* to 103*e* are further subtracted by the filter signals of the adjacent digital high cut filters 103*a* to 103*e* in the subtractors 104*a* to 104*d* (referred to overall as 104). In this embodiment of the present invention, the digital high cut filters 103*a* to 103*e* and the subtractors 104*a* to 104*e* are actually realized by processing in the DSP 25. The A/D converter 102 can be realized as part of the A/D converter block 27.

Figure 16:
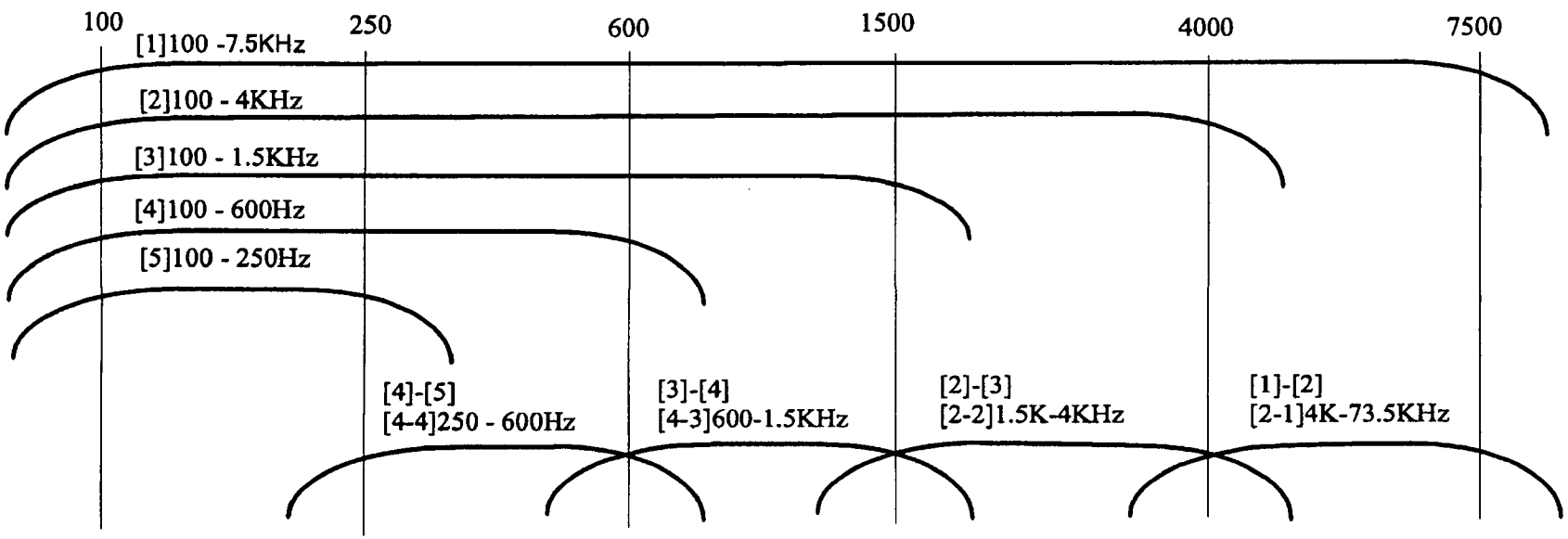
FIG. 16 is a view of a frequency characteristic of processing results of FIG. 15.

FIG. 16 is a view of the frequency characteristic showing the filter processing result explained by referring to FIG. 15. In this way, a plurality of signals having various types of frequency components are generated from signals picked up by microphones having single directivity.

Band-pass Filter Processing and Microphone Signal Level Conversion Processing

Figure 17:
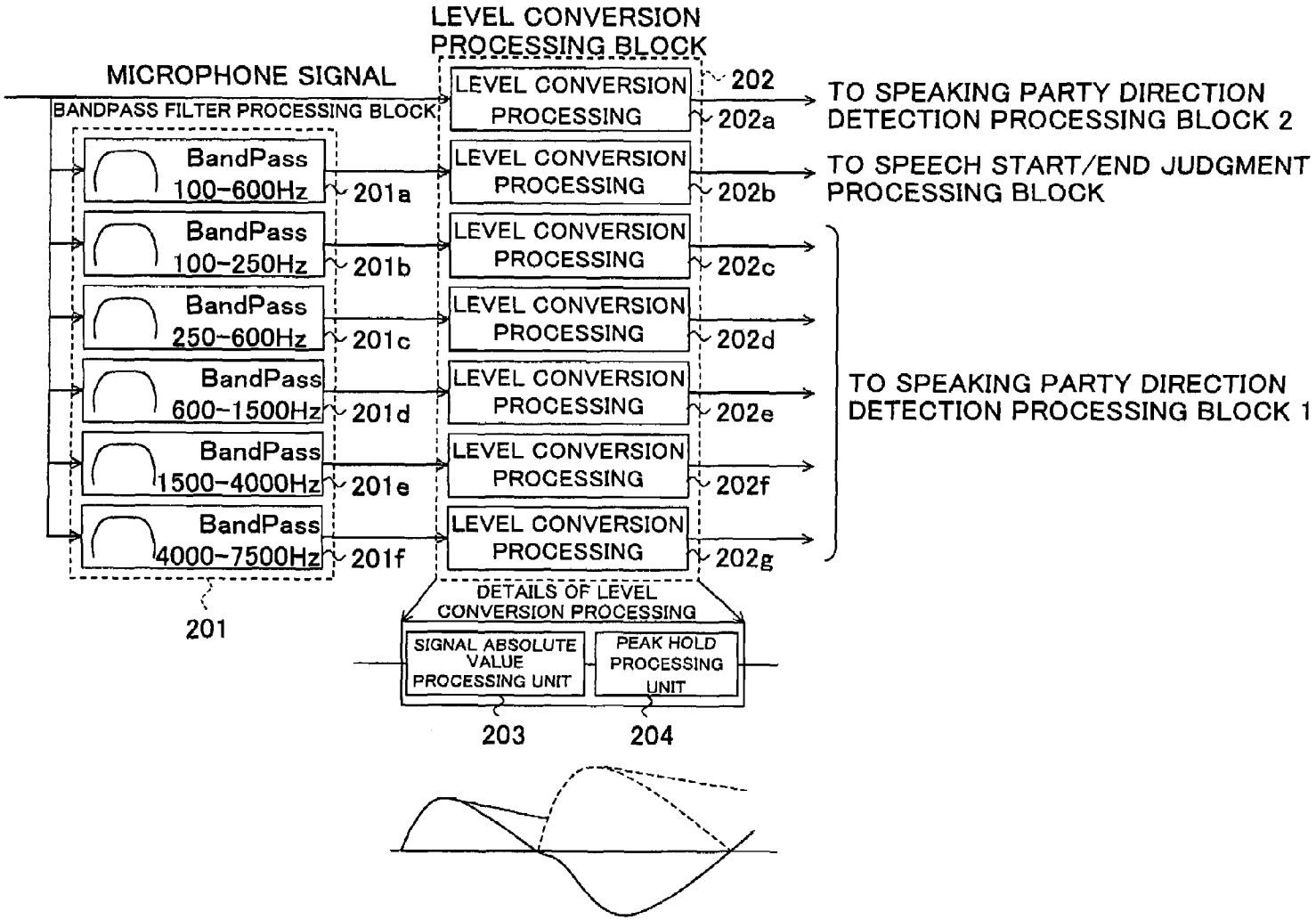
FIG. 17 is a block diagram of band pass filter processing and level conversion processing of the present invention.

As one of the triggers for start of the microphone selection processing, the start and end of the speech is judged. The signal used for this is obtained by the bandpass filter processing and the level conversion processing illustrated in FIG. 17 performed at the DSP 25. FIG. 17 shows only one channel (CH) of the processing of six channels of input signals picked up at the microphones MC1 to MC6. The bandpass filter processing and level conversion processing unit in the DSP 25 have, for the channels of the sound pickup signals of the microphones, bandpass filters 201*a* to 201*e* (referred to overall as the "bandpass filter block 201") having bandpass characteristics of 100 to 600 Hz, 200 to 250 Hz, 250 to 600 Hz, 600 to 1500 Hz, 1500 to 4000 Hz, and 4000 to 7500 Hz and level converters 202*a* to 202*g* (referred to overall as the "level converter block 202") for converting the levels of the original microphone sound pickup signals and the band-passed sound pickup signals.

Each of the level conversion units 202*a* to 202*g* has a signal absolute value processing unit 203 and a peak hold processing unit 204. Accordingly, as illustrated by the waveform, the signal absolute value processing unit 203 inverts the sign when receiving as input a negative signal indicated by a broken line to converts the same to a positive signal. The peak hold processing unit 204 holds the maximum value of the output signals of the signal absolute value processing unit 203. Note that in the present embodiment, the held maximum value drops a little along with the elapse of time. Naturally, it is also possible to improve the peak hold processing unit 204 to reduce the amount of drop and enable the maximum value to be held for a long time.

The bandpass filter will be explained next. The bandpass filter used in the communication apparatus 1 is for example comprised of just a secondary IIR high cut filter and a low cut filter of the microphone signal input stage. The present embodiment utilizes the fact that if a signal passed through the high cut filter is subtracted from a signal having a flat frequency characteristic, the remainder becomes substantially equivalent to a signal passed through the low cut filter. In order to match the frequency-level characteristics, one extra band of the bandpass filters of the full bandpass becomes necessary. The required bandpass is obtained by the number of bands and filter coefficients of the number of bands of the bandpass filters+1. The band frequency of the bandpass filter required this time is the following six bands of bandpass filters per channel (CH) of the microphone signal:

| BP characteristic | Bandpass filter |
|---|---|
| BPF1 = [100 Hz-250 Hz] | 201b |
| BPF2 = [250 Hz-600 Hz] | 201c |
| BPF3 = [600 Hz-1.5 kHz] | 201d |
| BPF4 = [1.5 kHz-4 kHz] | 201e |
| BPF5 = [4 kHz-7.5 kHz] | 201f |
| BPF6 = [100 Hz-600 Hz] | 201a |

In this method, the computation program of the IIR filters in the DSP 25 is only 6 CH (channel)×5 (IIR filter)=30. Compare this with the configuration of conventional bandpass filters. If configuring the bandpass filters using secondary IIR filters and preparing six bands of bandpass filters for six microphone signals as in the present invention, in the conventional method, the IIR filter processing of 6×6×2=72 circuits becomes necessary. This processing needs considerable program processing even by the newest excellent DSP and exerts an influence upon the other processing. In this embodiment of the present invention, 100 Hz low cut filter processing is realized by the analog filters of the input stage. There are five cut-off frequencies of the prepared secondary IIR high cut filters: 250 Hz, 600 Hz, 1.5 kHz, 4 kHz, and 7.5 kHz. The high cut filter having the cut-off frequency of 7.5 kHz among them actually has a sampling frequency of 16 kHz, so is unnecessary, but the phase of the subtracted number is intentionally rotated in order to reduce the phenomenon of the output level of the bandpass filter being reduced due to phase rotation of the IIR filter in the step of the subtraction processing.

Figure 18:
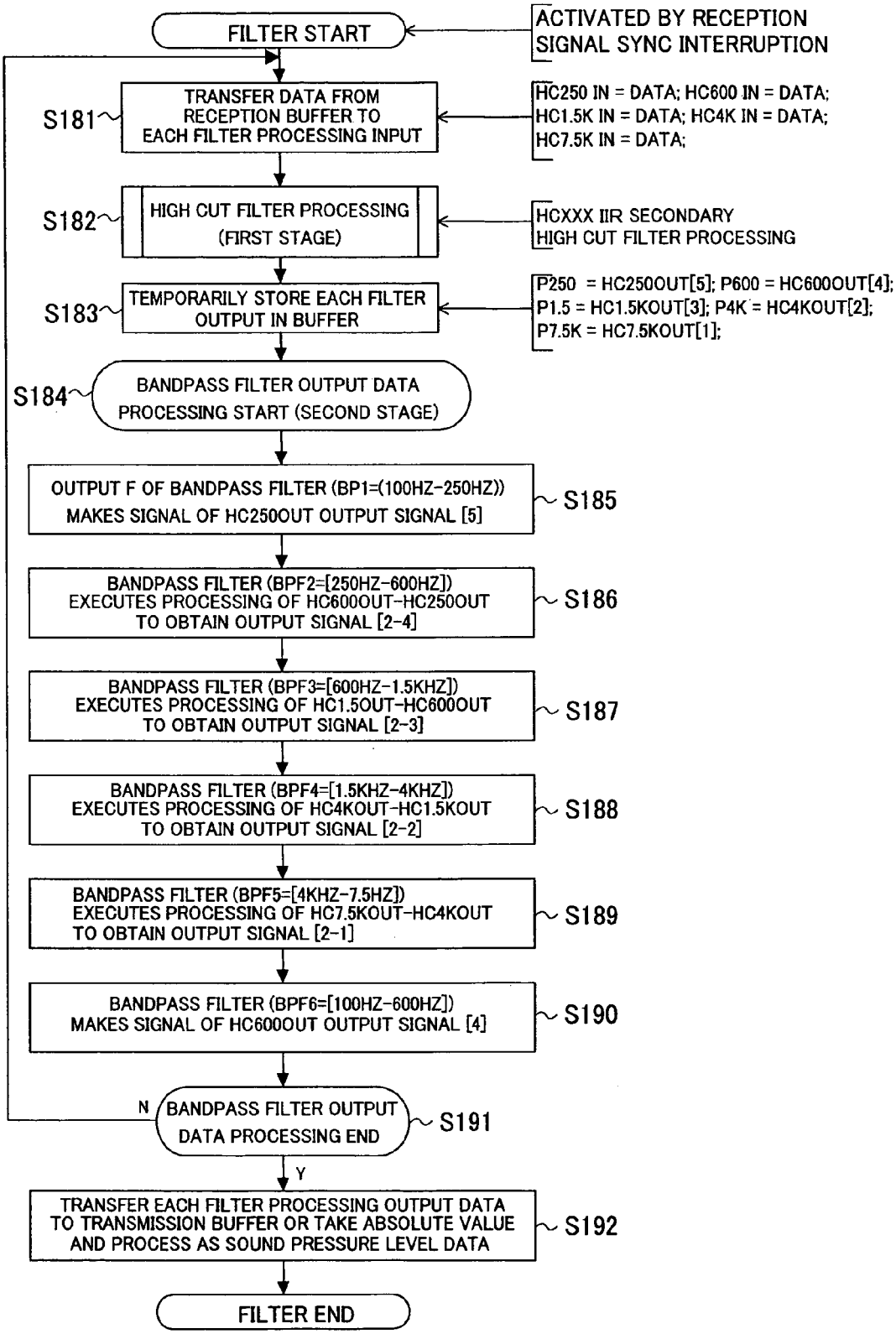
FIG. 18 is a flow chart of the processing of FIG. 17.

FIG. 18 is a flow chart of the processing by the configuration illustrated in FIG. 17 at the DSP 25.

In the filter processing at the DSP 25 illustrated in FIG. 18, the high pass filter processing is carried out as the first stage of processing, while the subtraction processing from the result of the first stage of the high pass filter processing is carried out as the second stage of processing. FIG. 16 is a view of the image frequency characteristics of the results of the signal processing. In the following explanation, [x] shows each processing case in FIG. 16.

First Stage

[1] For the full bandpass filter, the input signal is passed through the 7.5 kHz high cut filter. This filter output signal becomes the bandpass filter output of [100 Hz-7.5 kHz] by the analog low cut matching of inputs.

[2] The input signal is passed through the 4 kHz high cut filter. This filter output signal becomes the bandpass filter output of [100 Hz-4 kHz] by combination with the input analog low cut filter.

[3] The input signal is passed through the 1.5 kHz high cut filter. This filter output signal becomes the bandpass filter output of [100 Hz-1.5 kHz] by combination with the input analog low cut filter.

[4] The input signal is passed through the 600 kHz high cut filter. This filter output signal becomes the bandpass filter output of [100 Hz-600 kHz] by combination with the input analog low cut filter.

[5] The input signal is passed through the 250 kHz high cut filter. This filter output signal becomes the bandpass filter output of [100 Hz-250 kHz] by combination with the input analog low cut filter.

Second Stage

[1] When the bandpass filter (BPF5=[4 kHz to 7.5 kHz]) executes the processing of the filter output [1]-[2] ([100 Hz to 7.5 kHz]-[100 Hz to 4 kHz]), the above signal output [4 kHz to 7.5 kHz] is obtained.

[2] When the bandpass filter (BPF4=[1.5 kHz to 4 kHz]) executes the processing of the filter output [2]-[3] ([100 Hz to 4 kHz]-[100 Hz to 1.5 kHz]), the above signal output [1.5 kHz to 4 kHz] is obtained.

[3] When the bandpass filter (BPF3=[60 kHz to 1.5 kHz]) executes the processing of the filter output [3]-[4] ([100 Hz to 1.5 kHz]-[100 Hz to 600 Hz]), the above signal output [600 Hz to 1.5 kHz] is obtained.

[4] When the bandpass filter (BPF2=[250 Hz to 600 Hz]) executes the processing of the filter output [4]-[5] ([100 Hz to 600 Hz]-[100 Hz to 250 Hz]), the above signal output [250 Hz to 600 Hz] is obtained.

[5] The bandpass filter (BPF1=[100 Hz to 250 Hz]) defines the signal of the above [5] as is as the output signal of the above [5].

[6] The bandpass filter (BPF6=[100 Hz to 600 Hz]) defines the signal of the above [4] as is as the output signal of the above [4].

The required bandpass filter output is obtained by the above processing in the DSP 25.

The input sound pickup signals MIC1 to MIC6 of the microphones are constantly updated as in Table 1 as the sound pressure level of the entire band and the six bands of sound pressure levels passed through the bandpass filter.

TABLE 1

Results of Conversion of Signal Levels

| | BPF1 | BPF2 | BPF3 | BPF4 | BPF5 | BPF6 | ALL |
|---|---|---|---|---|---|---|---|
| MIC1 | L1-1 | L1-2 | L1-3 | L1-4 | L1-5 | L1-6 | L1-A |
| MIC2 | L2-1 | L2-2 | L2-3 | L2-4 | L2-5 | L2-6 | L2-A |
| MIC3 | L3-1 | L3-2 | L3-3 | L3-4 | L3-5 | L3-6 | L3-A |
| MIC4 | L4-1 | L4-2 | L4-3 | L4-4 | L4-5 | L4-6 | L4-A |
| MIC5 | L5-1 | L5-2 | L5-3 | L5-4 | L5-5 | L5-6 | L5-A |
| MIC6 | L6-1 | L6-2 | L6-3 | L6-4 | L6-5 | L6-6 | L6-A |

In Table 1, for example, L1-1 indicates the peak level when the sound pickup signal of the microphone MC1 passes through the first bandpass filter 201*a*. In the judgment of the start and end of speech, use is made of the microphone sound pickup signal passed through the 100 Hz to 600 Hz bandpass filter 201*a* illustrated in FIG. 17 and converted in sound pressure level at the level conversion unit 202*b*.

A conventional bandpass filter is configured by combining a high pass filter and low pass filter for each stage of the bandpass filter. Therefore filter processing of 72 circuits would become necessary if constructing 36 circuits of bandpass filters based on the specification used in the present embodiment. As opposed to this, the filter configuration of the embodiment of the present invention becomes simple as explained above.

Processing for Judgment of Start and End of Speech

Figure 19:
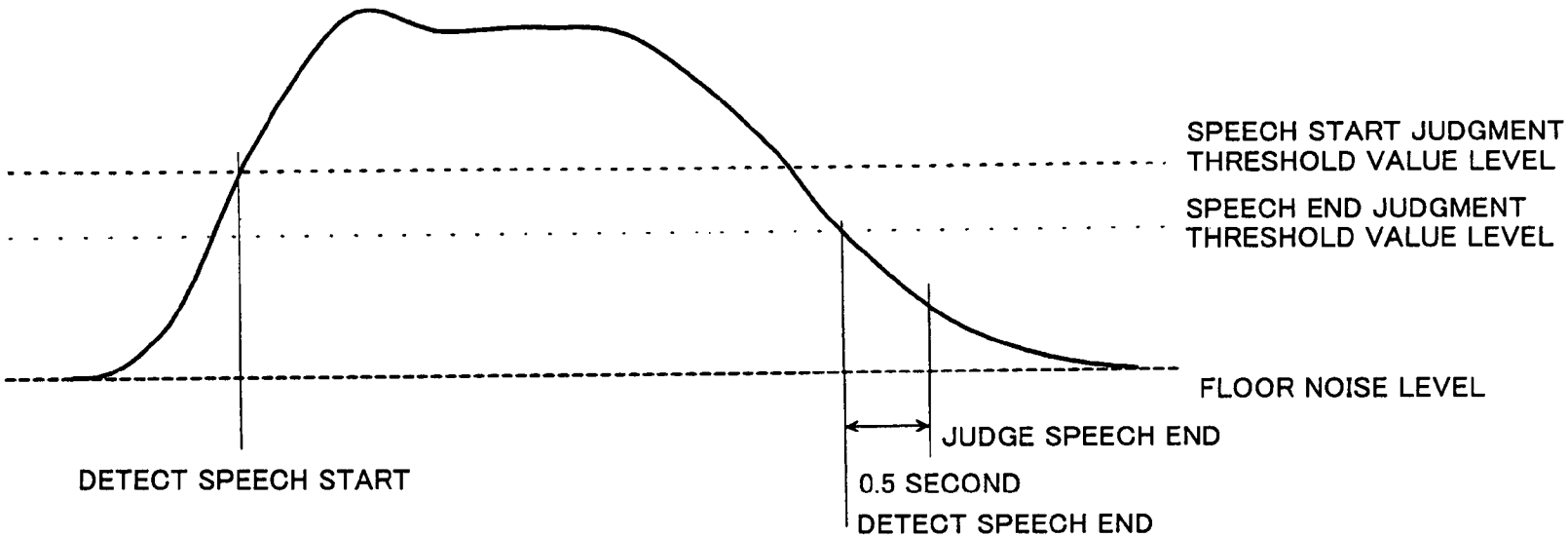
FIG. 19 is a graph showing processing for judging a start and an end of speech in the communication apparatus of the present invention.

Based on the value output from the sound pressure level detection unit, as illustrated in FIG. 19, the first digital signal processor (DSP1) 25 judges the start of speech when the microphone sound pickup signal level rises over the floor noise and exceeds the threshold value of the speech start level, judges speech is in progress when a level higher than the threshold value of the start level continues after that, judges there is floor noise when the level falls below the threshold value of the end of speech, and judges the end of speech when the level continues for the speech end judgment time, for example, 0.5 second. The start and end judgment of speech judges the start of speech from the time when the sound pressure level data (microphone signal level (1)) passing through the 100 Hz to 600 Hz bandpass filter and converted in sound pressure level at the microphone signal conversion processing unit 202*b* illustrated in FIG. 17 becomes higher than the threshold value level illustrated in FIG. 19. The DSP 25 is designed not to detect the start of the next speech during the speech end judgment time, for example, 0.5 second, after detecting the start of speech in order to avoid the malfunctions accompanying frequent switching of the microphones.

Microphone Selection

Figure 20:
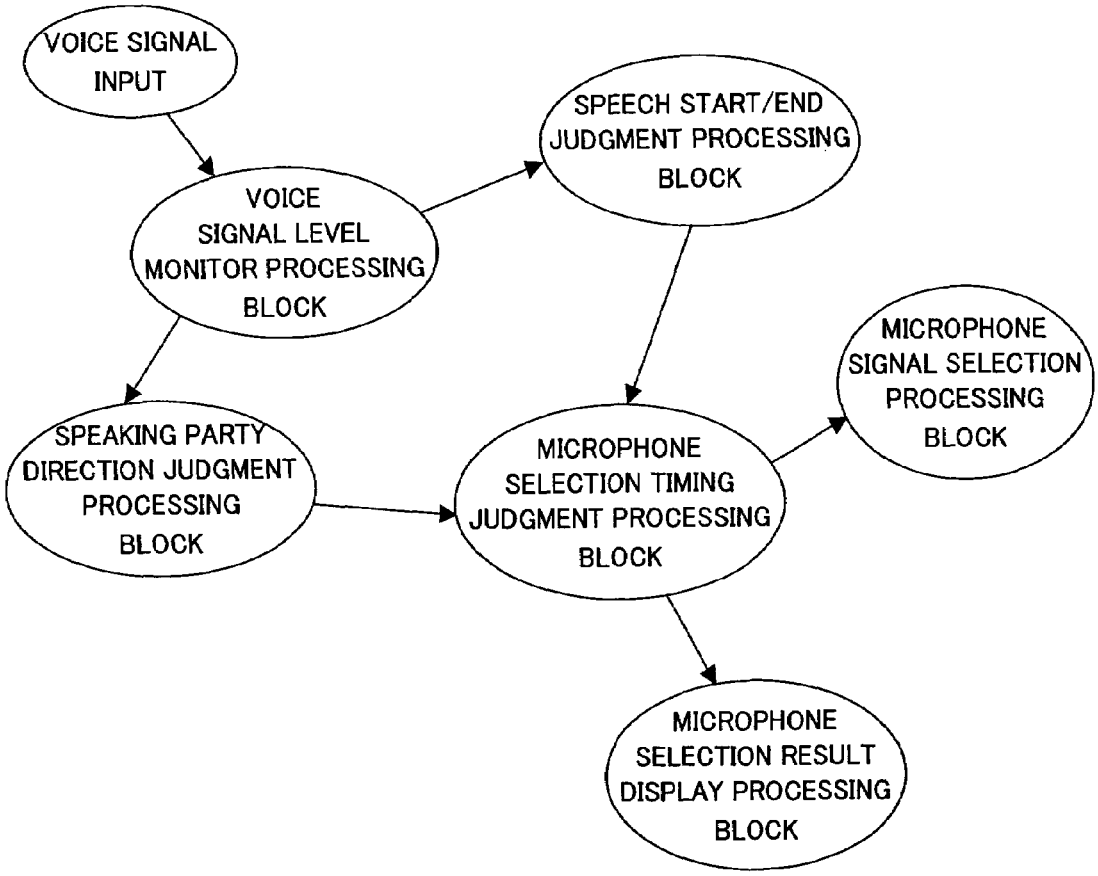
FIG. 20 is a chart of the flow of normal processing in the communication apparatus of the present invention.
Figure 21:
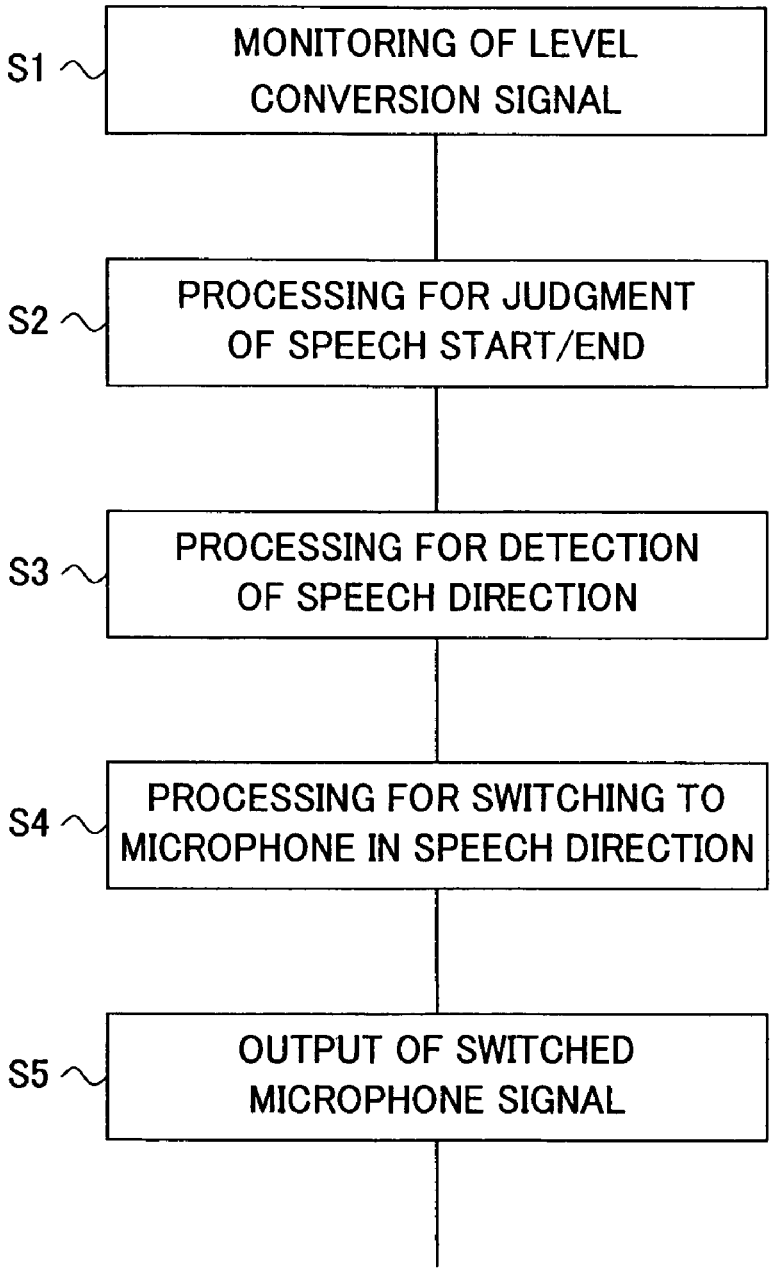
FIG. 21 is a chart of the flow of normal processing in the communication apparatus of the present invention.
Figure 22:
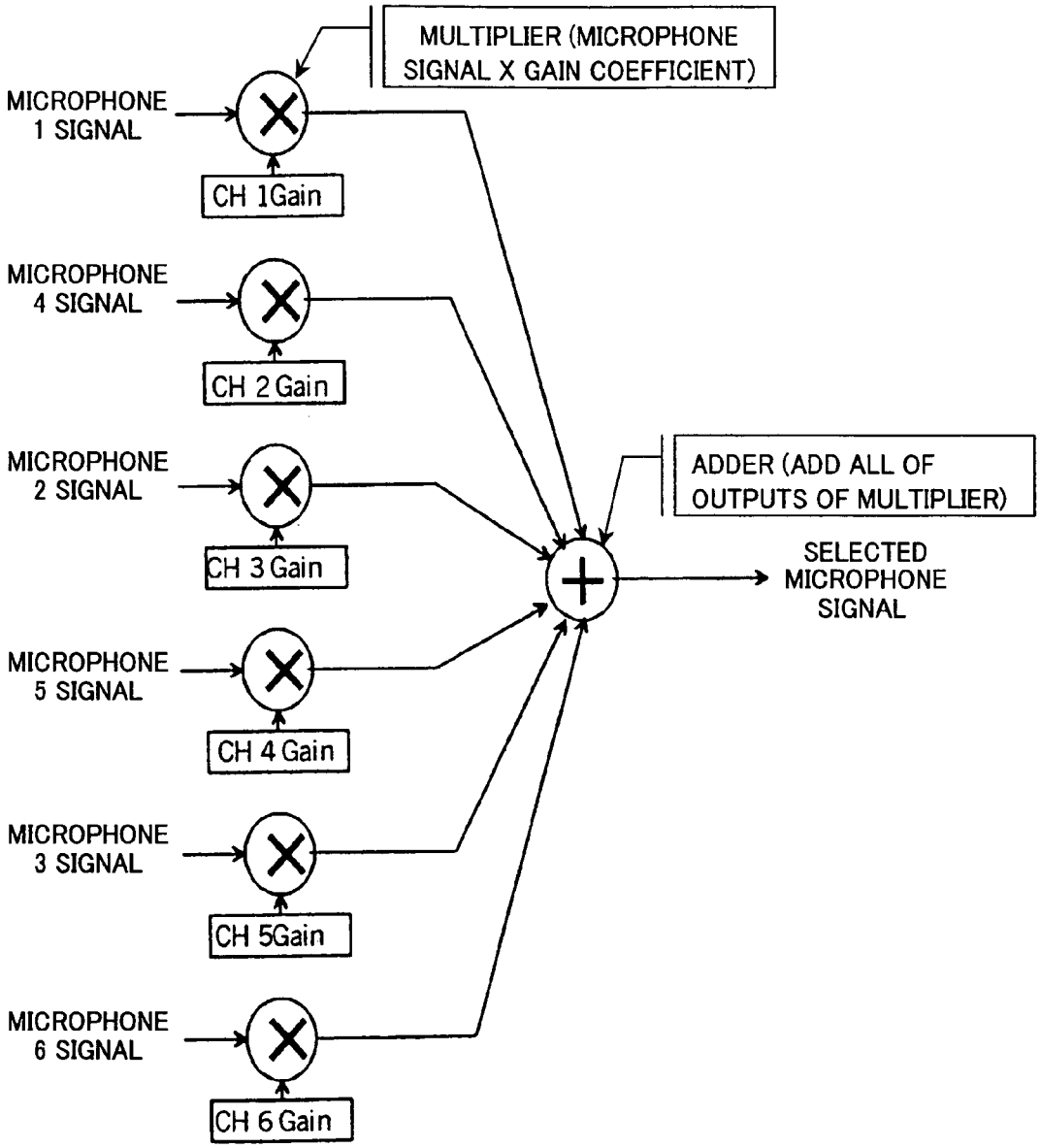
FIG. 22 is a block diagram illustrating microphone switching processing in the communication apparatus of the present invention.

The DSP 25 detects the direction of the speaking party in the mutual speech system and automatically selects the signal of the microphone facing to the speaking party based on the so-called "score card method". FIG. 20 is a view illustrating the types of operation of the communication apparatus 1. FIG. 21 is a flow chart showing the normal processing of the communication apparatus 1.

The communication apparatus 1, as illustrated in FIG. 20, performs processing for monitoring the audio signal in accordance with the sound pickup signals from the microphones MC1 to MC6, judges the speech start/end, judges the speech direction, and selects the microphone and displays the results on the microphone selection result displaying means 30, for example, the light emission diodes LED1 to LED6. Below, a description will be given of the operation mainly using the DSP 25 in the communication apparatus 1 by referring to the flow chart of FIG. 21. Note that the overall control of the microphone electronic circuit housing 2 is carried out by the microprocessor 23, but the description will be given focusing on the processing of the DSP 25.

Step 1: Monitoring of Level Conversion Signal

The signals picked up at the microphones MC1 to MC6 are converted as seven types of level data in the bandpass filter block 201 and the level conversion block 202 explained by referring to FIG. 16 to FIG. 18, especially FIG. 17, so the DSP 25 constantly monitors seven types of signals for the microphone sound pickup signals. Based on the monitor results, the DSP 25 shifts to either processing of the speaking party direction detection processing 1, the speaking party direction detection processing 2, or the speech start end judgment processing.

Step 2: Processing for Judgment of Speech Start/End

The DSP 25 judges the start and end of speech by referring to FIG. 19 and further according to the method explained in detail below. When detecting the start of speech, the DSP 25 informs the detection of the speech start to the speaking party direction judgment processing of step 4. Note that, in the processing for judgment of the start and end of speech at step 2, when the speech level becomes smaller than the speech end level, the timer of the speech end judgment time (for example 0.5 second) is activated. When the speech level is smaller than the speech end level during the speech end judgment, it is judged that the speech has ended. When it becomes larger than the speech end level during the speech end judgment, the wait processing is entered until it becomes smaller than the speech end level again.

Step 3: Processing for Detection of Speaking Party Direction

The processing for detection of the speaking party direction in the DSP 25 is carried out by constantly continuously searching for the speaking party direction. Thereafter, the data is supplied to the processing for judgment of the speaking party direction of step 4.

Step 4: Processing for Switching of Speaking Party Direction Microphone

The processing for judgment of timing in the processing for switching the speaking party direction microphone in the DSP 25 instructs the selection of a microphone in a new speaking party direction to the processing for switching the microphone signal of step 4 when the results of the processing of step 2 and the processing of step 3 are that the speaking party detection direction at that time and the speaking party direction which has been selected up to now are different. Note that when the chairman's microphone has been set from the operation unit 15 and the chairman's microphone and other conference participants simultaneously speak, priority is given to the speech of the chairman. At this time, the selected microphone information is displayed on the microphone selection result displaying means 30, for example, the light emission diodes LED1 to LED6.

Step 5: Transmission of Microphone Sound Pickup Signals

The processing for switching the microphone signal transmits only the microphone signal selected by the processing of step 4 from among the six microphone signals as the transmission signal from the communication apparatus 1 to the communication apparatus of the other party via the telephone line 920, so outputs it to the line-out terminal of the telephone line 920 illustrated in FIG. 5.

Set-Up of Speech Start Level Threshold Value and Speech End Threshold Value

Processing 1: A predetermined time's worth, for example, one second's worth, of floor noise, is measured for each microphone immediately after turning on the power. The DSP 25 reads out the peak held level values of the sound pressure level detection unit at constant time intervals, for example intervals of 10 msec in the present embodiment, calculates the mean value for the predetermined time, for example, one minute, and defines it as the floor noise. The DSP 25 determines the threshold value of the detection level of the speech start (floor noise +9 dB) and the threshold value of the detection level of the speech end (floor noise +6 dB) based on the measured floor noise level. The DSP 25 reads out the peak held level values of the sound pressure level detector at constant time intervals even after that. When it judges the end of speech, the DSP 25 acts for measuring the floor noise, detects the start of speech, and updates the threshold value of the detection level of the end of speech.

According to this method, since floor noise levels of the positions where microphones are placed differ from each other, this threshold value setting can set each threshold value for each microphone and can prevent erroneous judgment in the selection of the microphone due to a noise sound source.

Processing 2: Correspondence to Room of Surrounding Noise (Having Large Floor Noise)

When the floor noise is large and the threshold level is automatically updated in the processing 1, the processing 2 performs the following as a countermeasure for when detection of the start or end of speech is hard. The DSP 25 determines the threshold values of the detection level of the start of speech and the detection level of the end of speech based on the predicted floor noise level. The DSP 25 sets the speech start threshold value level larger than the speech end threshold value level (a difference of for example 3 dB or more). The DSP 25 reads out the peak held level values at constant time intervals by the sound pressure level detector.

According to this method, since the threshold value is the same value with respect to all microphones, this threshold value setting enables speech start to be recognized by the magnitudes of the voices of persons with their backs to the noise source and the voices of other persons being the same degree.

Judgment of Speech Start

Processing 1: The output levels of the sound pressure level detector corresponding to the six microphones and the threshold value of the speech start level are compared. The start of speech is judged when the output level exceeds the threshold value of the speech start level. When the output levels of the sound pressure level detector corresponding to all microphones exceed the threshold value of the speech start level, the DSP 25 judges the signal to be from the receiving and reproduction speaker 16 and does not judge that speech has started. This is because the distances between the receiving and reproduction speaker 16 and all microphones MC1 to MC6 are the same, so the sound from the receiving and reproduction speaker 16 reaches all microphones MC1 to MC6 almost equally.

Processing 2: Three sets of microphones each comprised of two single directivity microphones (microphones MC1 and MC4, microphones MC2 and MC5, and microphones MC3 and MC6) obtained by arranging the six microphones illustrated in FIG. 4 at equal angles of 60 degrees radially and at equal intervals and having directivity axes shifted by 180 degrees in opposite directions are prepared, and the level differences of two microphone signals are utilized. Namely, the following operations are executed:

Absolute value of (signal level of microphone 1−signal level of microphone 4) [1]

Absolute value of (signal level of microphone 2−signal level of microphone 5) [2]

Absolute value of (signal level of microphone 3−signal level of microphone 6) [3]

The DSP 25 compares the above absolute values [1], [2], and [3] with the threshold value of the speech start level and judges the speech start when the absolute value exceeds the threshold value of the speech start level. In the case of this processing, all absolute values do not become larger than the threshold value of the speech start level unlike the processing 1 (since sound from the receiving and reproduction speaker 16 equally reaches all microphones), so judgment of whether the sound is from the receiving and reproduction speaker 16 or audio from a speaking party becomes unnecessary.

Processing for Detection of Speaking Party Direction

Figure 7A:
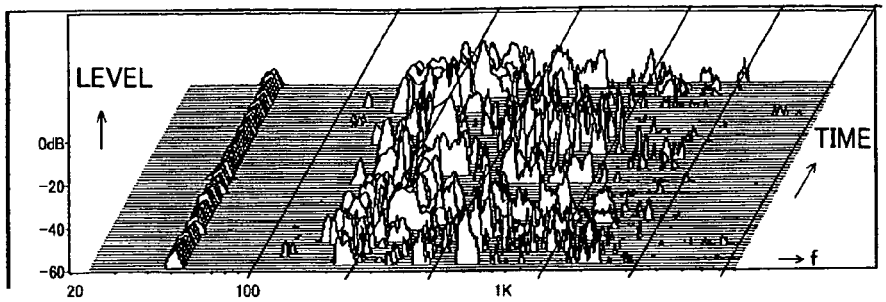
FIGS. 7A to 7D are graphs showing results of analysis of the directivities of microphones having the characteristics illustrated in FIG. 6.
Figure 7B:
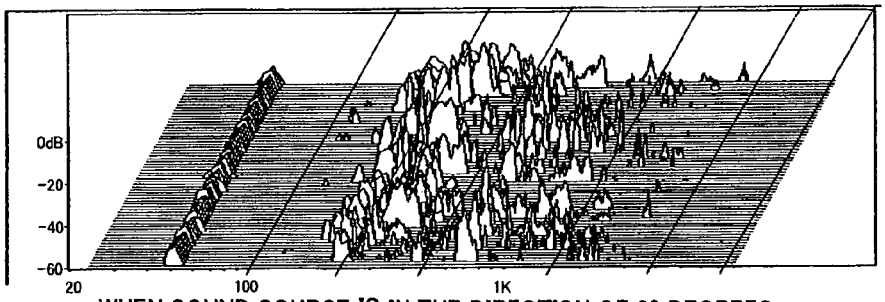
Figure 7C:
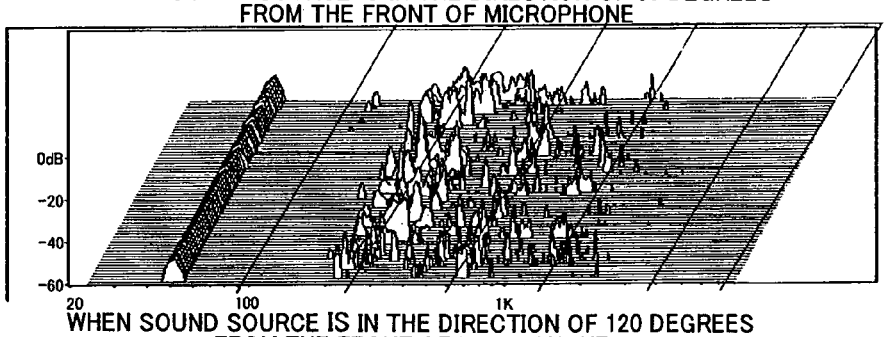
Figure 7D:
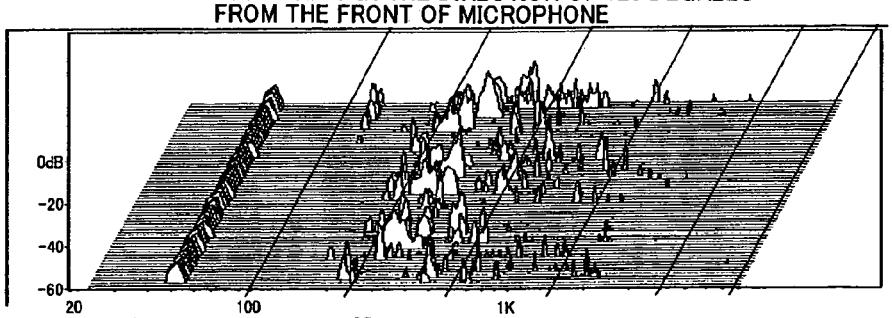

For the detection of the speaking party direction, the characteristics of the single directivity microphones exemplified in FIG. 6 are utilized. In the single directivity characteristic microphones, as exemplified in FIG. 6, the frequency characteristic and level characteristic change according to the angle of the audio from the speaking party reaching the microphones. The results are shown in FIGS. 7A to 7C. FIGS. 7A to 7C show the results of application of a fast fourier transform (FFT) to audio picked up by microphones at constant time intervals by placing the speaker a predetermined distance from the communication apparatus 1, for example, a distance of 1.5 meters. The X-axis represents the frequency, the Y-axis represents the signal level, and the Z-axis represents time. The lateral lines represent the cut-off frequency of the bandpass filter. The level of the frequency band sandwiched by these lines becomes the data from the microphone signal level conversion processing passing through five bands of bandpass filters and converted to the sound pressure level explained by referring to FIG. 15 to FIG. 18.

The method of judgment applied as the actual processing for detecting the speaking party direction in the communication apparatus 1 according to an embodiment of the present invention will be described next. Suitable weighting processing (0 when 0 dBFs in a 1 dB full span (1 dBFs) step, while 3 when −3 dBFs, or vice versa) is carried out with respect to the output level of each band of bandpass filter. The resolution of the processing is determined by this weighting step. The above weighting processing is executed for each sample clock, the weighted scores of each microphone are added, the result is averaged for the constant number of samples, and the microphone signal having a small (large) total points is judged as the microphone facing the speaking party. The following Table 2 indicates the results of this as an image.

TABLE 2

| | Case Where Signal Levels Are Represented by Points | | | | | |
|---|---|---|---|---|---|---|
| | BPF1 | BPF2 | BPF3 | BPF4 | BPF5 | Sum |
| MIC1 | 20 | 20 | 20 | 20 | 20 | 100 |
| MIC2 | 25 | 25 | 25 | 25 | 25 | 125 |
| MIC3 | 30 | 30 | 30 | 30 | 30 | 150 |
| MIC4 | 40 | 40 | 40 | 40 | 40 | 200 |
| MIC5 | 30 | 30 | 30 | 30 | 30 | 150 |
| MIC6 | 25 | 25 | 25 | 25 | 25 | 125 |

In the example illustrated in Table 2, the first microphone MC1 has the smallest total points, so the DSP 25 judges that there is a sound source (there is a speaking party) in the direction of the first microphone MC1. The DSP 25 holds the result in the form of a sound source direction microphone number. As explained above, the DSP 25 weights the output level of the bandpass filter of the frequency band for each microphone, ranks the outputs of the bands of bandpass filters in the sequence from the microphone signal having the smallest (largest) point up, and judges the microphone signal having the first order for three bands or more as from the microphone facing the speaking party. Then, the DSP 25 prepares the score card as in the following Table 3 indicating that there is a sound source (there is a speaking party) in the direction of the first microphone MC1.

TABLE 3

| | Case Where Signals Passed Through Bandpass Filters Are Ranked In Level Sequence | | | | | |
|---|---|---|---|---|---|---|
| | BPF1 | BPF2 | BPF3 | BPF4 | BPF5 | Sum |
| MIC1 | 1 | 1 | 1 | 1 | 1 | 5 |
| MIC2 | 2 | 2 | 2 | 2 | 2 | 10 |
| MIC3 | 3 | 3 | 3 | 3 | 3 | 15 |
| MIC4 | 4 | 4 | 4 | 4 | 4 | 20 |
| MIC5 | 3 | 3 | 3 | 3 | 3 | 15 |
| MIC6 | 2 | 2 | 2 | 2 | 2 | 10 |

In actuality, due to the influence of the reflection of sound and standing wave according to the characteristics of the room, the result of the first microphone MC1 does not always become the top among the outputs of all bandpass filters, but if the first rank in the majority of five bands, it can be judged that there is a sound source (there is a speaking party) in the direction of the first microphone MC1. The DSP 25 holds the result in the form of the sound source direction microphone number.

The DSP 25 totals up the output level data of the bands of the bandpass filters of the microphones in the form shown in the following, judges the microphone signal having a large level as from the microphone facing the speaking party, and holds the result in the form of the sound source direction microphone number.

MIC1 Level=L1-1+L1-2+L1-1+L1-4+L1-5

MIC2 Level=L2-1+L2-2+L2-1+L2-4+L2-5

MIC3 Level=L3-1+L3-2+L3-1+L3-4+L3-5

MIC4 Level=L4-1+L4-2+L4-1+L4-4+L4-5

MIC5 Level=L5-1+L5-2+L5-1+L5-4+L5-5

MIC6 Level=L6-1+L6-2+L6-1+L6-4+L6-5

Processing for Judgment of Switch Timing of Speaking Party Direction Microphone

When activated by the speech start judgment result of step 2 of FIG. 21 and detecting the microphone of a new speaking party from the detection processing result of the speaking party direction of step 3 and the past selection information, the DSP 25 issues a switch command of the microphone signal to the processing for switching selection of the microphone signal of step 5, notifies the microphone selection result displaying means 30 (light emission diodes LED1 to 6) that the speaking party microphone was switched, and thereby informs the speaking party that the communication apparatus 1 has responded to his speech.

In order to eliminate the influence of reflection sound and the standing wave in a room having a large echo, the DSP 25 prohibits the issuance of a new microphone selection command unless the speech end judgment time (for example 0.5 second) passes after switching the microphone. It prepares two microphone selection switch timings from the microphone signal level conversion processing result of step 1 of FIG. 21 and the detection processing result of the speaking party direction of step 3 in the present embodiment.

First method: Time when speech start can be clearly judged

Case where speech from the direction of the selected microphone is ended and there is new speech from another direction.

In this case, the DSP 25 decides that speech is started after the speech end judgment time (for example 0.5 second) or more passes after all microphone signal levels (1) and microphone signal levels (2) become the speech end threshold value level or less and when any one microphone signal level (1) becomes the speech start threshold value level or more, determines the microphone facing the speaking party direction as the legitimate sound pickup microphone based on the information of the sound source direction microphone number, and starts the microphone signal selection switch processing of step 5.

Second method: Case where there is new speech of larger voice from another direction during period where speech is continued In this case, the DSP 25 starts the judgment processing after the speech end judgment time (for example 0.5 second) or more passes from the speech start (time when the microphone signal level (1) becomes the threshold value level or more). When it judges that the sound source direction microphone number from the processing of 3 changed before the detection of the speech end and it is stable, the DSP 25 decides there is a speaking party speaking with a larger voice than the speaking party which is selected at present at the microphone corresponding to the sound source direction microphone number, determines the sound source direction microphone as the legitimate sound pickup microphone, and activates the microphone signal selection switch processing of step 5.

Processing for Switching Selection of Signal of Microphone Facing Detected Speaking Party The DSP 25 is activated by the command selectively judged by the command from the switch timing judgment processing of the speaking party direction microphone of step 4 of FIG. 21. The processing for switching the selection of the microphone signal of the DSP 25 is realized by six multipliers and a six input adder. In order to select the microphone signal, the DSP 25 makes the channel gain (CH gain) of the multiplier to which the microphone signal to be selected is connected [1] and makes the CH gain of the other multipliers [0], whereby the adder adds the selected signal of (microphone signal x [1]) and the processing result of (microphone signal x [0]) and gives the desired microphone selection signal at the output.

Figure 23:
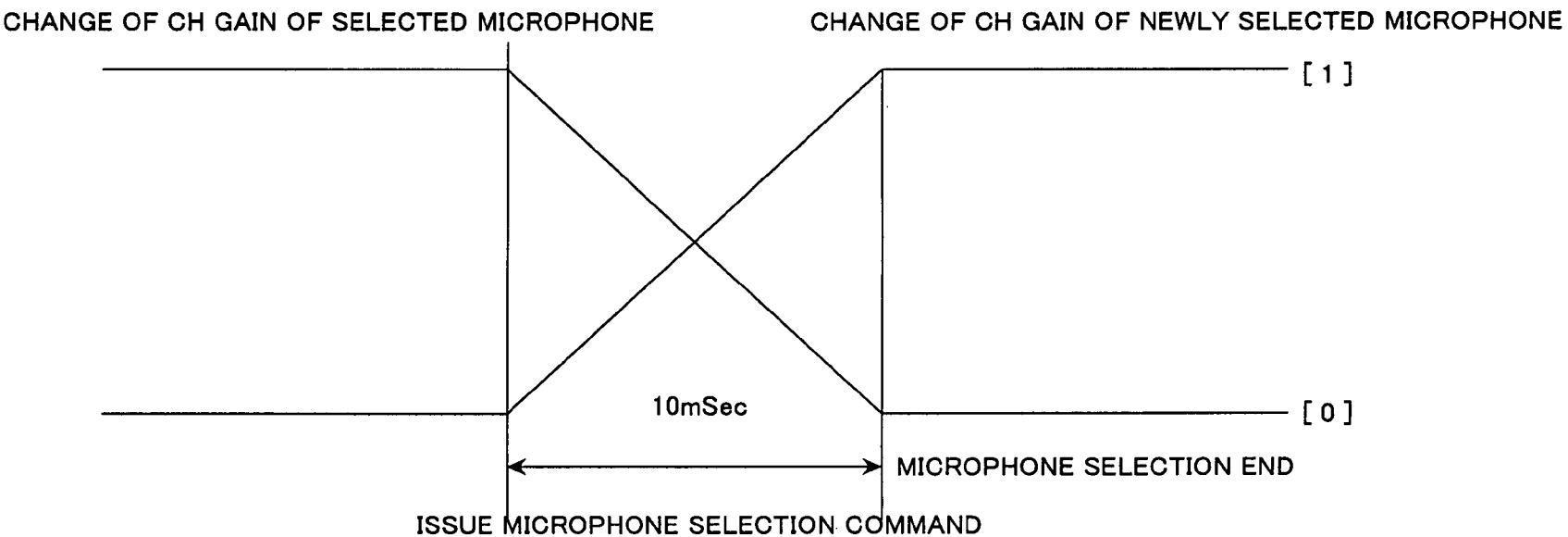
FIG. 23 is a block diagram illustrating a method of the microphone switching processing in the communication apparatus of the present invention.

When the channel gain is switched to [1] or [0] as described above, there is a possibility that a clicking sound will be generated due to the level difference of the microphone signals switched. Therefore, in the two-way communication apparatus 1, as illustrated in FIG. 23, the change of the CH gain from [1] to [0] and [0] to [1] is made continuous for the switch transition time, for example, a time of 10 msec, to cross and thereby avoid the clicking sound due to the level difference of the microphone signals.

Further, by setting the maximum channel gain to other than [1], for example [0.5], the echo cancellation processing operation in the later DSP 25 can be adjusted.

As explained above, the communication apparatus of the first embodiment of the present invention can be effectively applied to a two-way conference such as conference without the influence of noise. Naturally, the communication apparatus of the present invention is not limited to conference use and can be applied to various other purposes as well. Namely, the communication apparatus of the first embodiment of the present invention is also suited to measurement of the voltage level of the pass band when it is not necessary to stress the group delay characteristic of the pass bands. Accordingly, for example, it can also be applied to a simple spectrum analyzer, a level meter for applying fast fourier transform (FFT) processing (FFT like meter), a level detection processor for confirming the equalizer processing result of a graphic equalizer etc., level meters for car stereos, radio cassette recorders, etc., etc.

The communication apparatus of the first embodiment of the present invention has the following advantages from the viewpoint of structure:

(1) The positional relationships between the plurality of microphones having the single directivity and the receiving and reproduction speaker are constant and the distances between them are very close, therefore the level of the sound output from the receiving and reproduction speaker directly returning is overwhelmingly larger and dominant than the level of the sound output from the receiving and reproduction speaker passing through the conference room (room) environment and returning to the plurality of microphones. Due to this, the characteristics of the sound reaching from the receiving and reproduction speaker to the plurality of microphones (signal levels (intensities), frequency characteristics (f characteristics), and phases) are always the same. That is, the communication apparatus of the present invention has the advantage that the transmission function is always the same.

(2) Therefore, there is the advantage that there is no change of the transmission function when switching the microphone, therefore it is not necessary to adjust the gain of the microphone system whenever the microphone is switched. In other words, there is the advantage that it is not necessary to re-do the adjustment when the adjustment is once carried out at the time of manufacture of the communication apparatus.

(3) Even if the microphone is switched for the same reason as the above description, the number of echo cancellers configured by the digital signal processor (DSP) may be kept to one. A DSP is expensive, and also the space for arranging the DSP on the printed circuit board, which has little empty space since various members are mounted, may be kept small.

(4) The transmission functions between the receiving and reproduction speaker and the plurality of microphones are constant, so there is the advantage that the adjustment of the sensitivity difference of a microphone per se of ±3 dB can be carried out just by the unit.

(4) As the table on which the communication apparatus is mounted, usually use is made of a round table. It became possible to utilize this as the speaker system for equally dispersing (scattering) audio having a uniform quality in the entire orientation by one receiving and reproduction speaker in the communication apparatus.

(5) The sound output from the receiving and reproduction speaker is propagated through the table surface (boundary effect) and good quality sound effectively, efficiently, and equally reaches the conference participants, the sound at the opposing side is cancelled in phase in the ceiling direction of the conference room to become a small sound, there is a little reflection sound from the ceiling direction to the conference participants, and as a result a clear sound is distributed to the participants.

(6) The sound output from the receiving and reproduction speaker simultaneously arrives at all of the plurality of microphones with the same volume, therefore it becomes easy to decide the sound is audio of a speaking party or received audio. As a result, erroneous decision in the microphone selection processing is reduced.

(7) By arranging an even number of microphones at equal angles radially and at equal intervals, the level comparison for detecting the direction can be easily carried out.

(8) By the dampers using a buffer material, the microphone support members having flexibility or resiliency, etc., the influence upon the sound pickup of the microphones due to the vibration of the sound of the receiving and reproduction speaker transmitted via the printed circuit board on which the microphones are mounted can be reduced.

(9) The sound of the receiving and reproduction speaker does not directly enter the microphones. Accordingly, in this communication apparatus, there is a little influence of the noise from the receiving and reproduction speaker.

The communication apparatus of the first embodiment of the present invention has the following advantages from the viewpoint of the signal processing:

(a) A plurality of single directivity microphones are arranged at equal intervals radially to enable the detection of the sound source direction, and the microphone signal is switched to pick up sound having a good S/N and clear sound and transmit it to the other parties.

(b) It is possible to pick up sounds from surrounding speaking parties with a good S/N and automatically select the microphone facing the speaking party.

(c) In the present invention, as the method of the microphone selection processing, the pass audio frequency band is divided and the levels at the times of the divided frequency bands are compared to thereby simplify the signal analysis.

(d) The microphone signal switch processing of the present invention is realized as signal processing of the DSP. All of the plurality of signals are cross faded to prevent a clicking sound from being issued when switching.

(e) The microphone selection result can be notified to microphone selection result displaying means such as light emission diodes or the outside. Accordingly, it is also possible to make good use of this as speaking party position information for a TV camera.

Second Embodiment

As a second embodiment of the integral microphone and speaker configuration type communication apparatus (communication apparatus) of the present invention, the technique for automatically adjusting the sensitivity difference of the microphones will be explained.

As the method for adjusting the gain of the amplifier of the microphone, the method of adjusting the gain of the microphone use analog amplifier to absorbing the sensitivity difference of the microphones is generally imagined, but in such a method, there is a tendency for the influence of the adjuster such as the reflection and absorption of the sound to appear. Namely, a difference easily occurs in the adjustment level between the time when the adjuster is located near a microphone during the adjustment and the time when the adjuster is away from the microphone. Further, in such method, troublesome work such as connection and disconnection of the output signal of the microphone use amplifier and the measurement device becomes necessary. In the second embodiment of the present invention, in order to overcome the above problems, the sensitivity difference of the microphones is automatically adjusted by the following method:

The sensitivity difference of the microphones is adjusted in the second embodiment of the present invention based on the following concept:

1. The communication apparatus 1 of the embodiment of the present invention has, for example as illustrated in FIG. 5, a receiving and reproduction speaker 16. Therefore, when the reference signal is brought to the line-in terminal, it can be input to the DSP 26 and the DSP 25 via the A/D converter 274, so the advantage that the sensitivity difference of the microphones can be adjusted without providing a special measurement device is utilized.

2. The error range of the sensitivity difference can be freely set by the program of the DSP 25.

3. By performing the automatic adjustment, microphones failing to meet the standard are decided and misconnection is detected. In the same way, defects in the amplification unit for amplifying the signals of the microphones is detected.

Pre-conditions

As the pre-conditions, in the second embodiment, an even number of, for example, six, microphones are arranged at equal angle radially and at equal intervals and further at equal distances from the receiving and reproduction speaker 16 as illustrated in FIG. 4. As the positional relationship between the microphones MC1 to MC6 and the receiving and reproduction speaker 16, as illustrated in FIG. 3, the receiving and reproduction speaker 16 may be arranged below the microphones MC1 to MC6 or, as illustrated in FIG. 3, the receiving and reproduction speaker 16 may be arranged above the microphones MC1 to MC6.

Hardware Configuration

Figure 24:
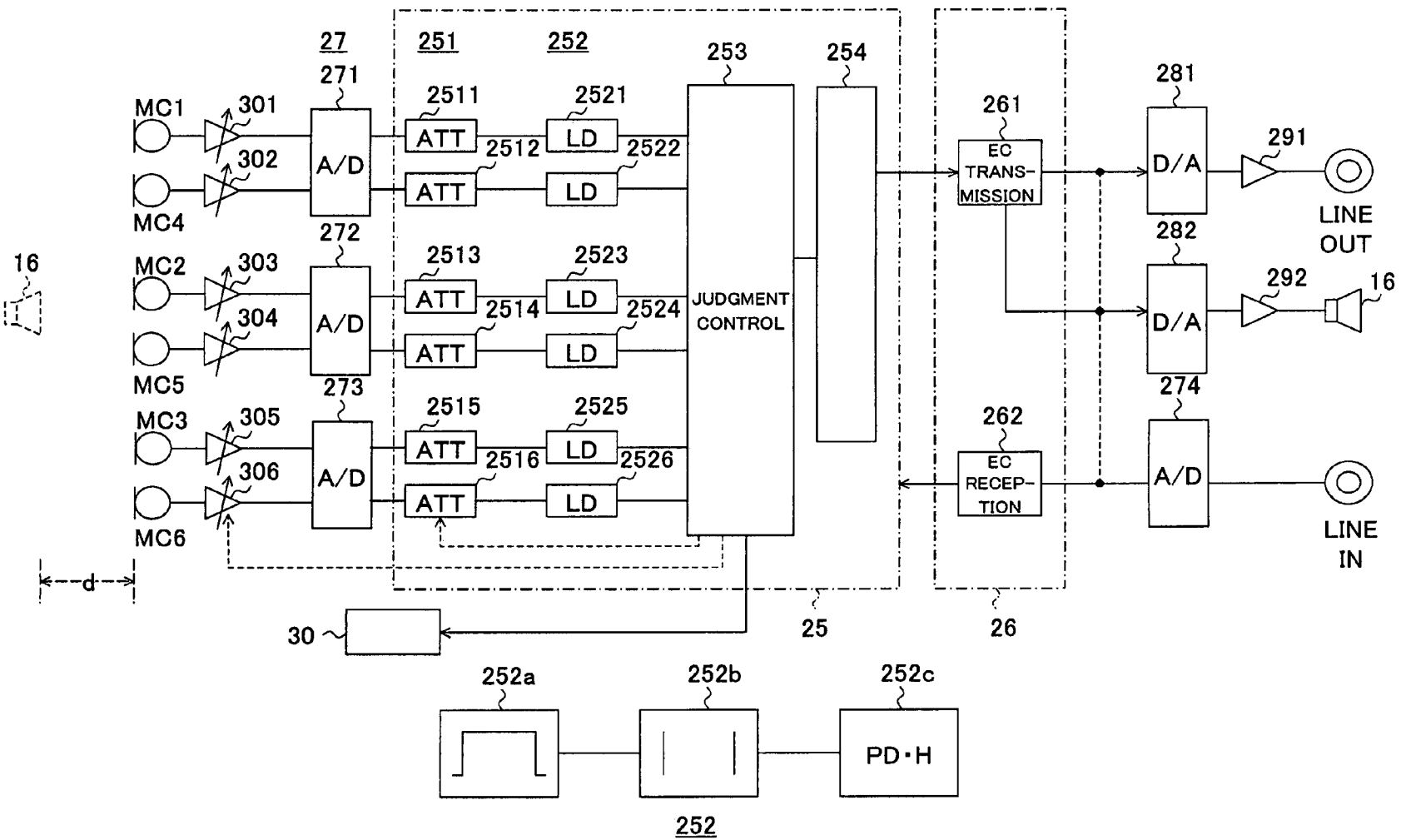
FIG. 24 is a block diagram illustrating a partial configuration of the communication apparatus of a second embodiment of the present invention.

The hardware configuration for the second embodiment is illustrated in FIG. 5. For the details, see the configuration illustrated in FIG. 24 and FIG. 25. In FIG. 24, between the microphones MC1 to MC6 and the A/D converters 271 to 273 in FIG. 5, in actuality, variable gain amplifiers 301 to 306 for performing the gain adjustment are arranged. Alternatively, the A/D converters 271 to 274 in FIG. 5 may be replaced by A/D converters 271 to 274 equipped with variable gain amplifiers 301 to 306. The DSP 25 performs various types of processing explained above. As the portion for adjusting the sensitivity difference of the amplifiers 301 to 306, provision is made of first to sixth variable attenuation units (ATT) 2511 to 2516, first to sixth level detection units 2521 to 2526, a level judgment and gain control unit 253, and a test signal generation unit 254. The DSP 26 has an echo cancellation speech transmitter 261 and an echo cancellation speech receiver 262.

The variable gain amplifiers 301 to 306 are amplifiers able to change the gain. The level judgment and gain control unit 253 performs the gain adjustment. However, when the variable gain amplifiers 301 to 306 are built in the A/D converters 271 to 273, the gain adjustment cannot be freely carried out. Namely, sometimes whether the gain adjustment can be freely carried out is unclear. Due to the constraints of the control width of the variable gain amplifiers 301 to 306, in the present embodiment, the processing is carried out according to the situation of the variable gain amplifiers 301 to 306.

The variable attenuation units 2511 to 2516 are attenuation units able to change the attenuation amount. The level judgment and gain control unit 253 controls the attenuation amount by outputting an attenuation coefficient 0.0 to 1.0. Note that the variable attenuation units 2511 to 2516 are realized by processing in the DSP 25, therefore, in actuality, the level judgment and gain control unit 253 in the same DSP 25 will control (adjust) the attenuation value of the portion of the variable attenuation units 2511 to 2516.

Each of the level detection units 2521 to 2526 is configured by a bandpass filter 252*a*, an absolute value attenuation unit 252*b*, and a peak level detection and holding unit 252*c* and basically has the same configuration as illustrated in FIG. 17. The operation of the circuit configuration illustrated in FIG. 17 was explained before.

Figure 25:
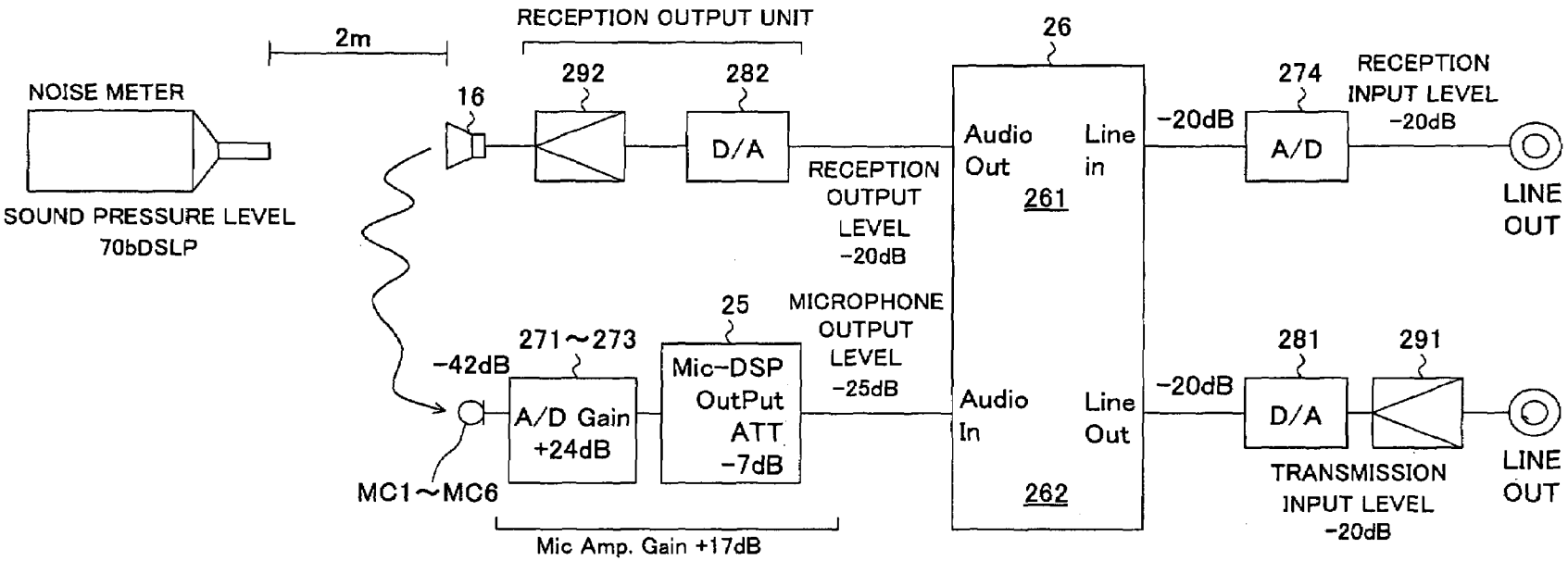
FIG. 25 is a block diagram illustrating a partial configuration of the communication apparatus of the second embodiment of the present invention.

FIG. 25 is a view modifying the illustration of the hardware configuration illustrated in FIG. 24 according to the mode of operation of the present embodiment and illustrates the signal attenuation amount. When a test sound is issued from the noise meter or the receiving and reproduction speaker 16 in a room (conference room) of certain degree of size, unless there is an especially reflecting object or sound absorbing object, an almost equivalent signal will reach the microphones MC1 to MC6 arranged at equal distances d from the noise meter or the receiving and reproduction speaker 16. The test audio from the noise meter or the receiving and reproduction speaker 16 picked up by the microphones MC1 to MC6 are amplified at the variable gain amplifiers 301 to 306, converted to digital signals at the A/D converters 271 to 273, and attenuated at the variable attenuation units 2511 to 2516 in the DSP 25. The frequency components of the predetermined band pass through the bandpass filters 252*a* in the level detection units 2521 to 2526, the absolute value operation units 252*b* perform the operation shown in Table 6, and the peak level detection and holding units 252*c* detect the maximum value and holds it. The level judgment and gain control unit 253 adjusts the attenuation amounts (attenuation coefficients) of the variable attenuation units 2511 to 2516 and adjusts the sensitivity difference of the microphones MC1 to MC6.

Design Value of Sensitivity Difference Adjustment Error

In the second embodiment, a microphone of for example ±3 dB as the nominal error of the microphone sensitivity is assumed. Further, in the second embodiment, a design value of the sensitivity difference adjustment error within for example 0.5 dB is aimed at. Note that this changes according to the environment where the two-way communication apparatus is disposed, therefore for example about 0.5 to 1.0 dB is proper as the actual sensitivity difference adjustment error.

The test signal generation unit 254 inputs pink noise of the reference input level (generating a sufficiently large sound pressure with respect to the surrounding noise), for example, a pink noise of 20 dB, to the line-in terminal and outputs the sound from the receiving and reproduction speaker 16. Alternatively, as indicated by the broken line in FIG. 24, it is also possible to pass the test signal from the test signal generation unit 254 through the echo cancellation speech transmitter 261 and input it to the DSP 25 again.

The method for adjusting the microphone sensitivity difference may be classified to the following cases 1 to 5 according to the circuit configuration conditions of the variable gain amplifiers 301 to 306. The processing is carried out according to the case in the present embodiment.

Case 1: Case where the variable gain amplifiers 301 to 306 are not built-in A/D converters 271 to 273, but are provided as independent amplifiers 301 to 306, therefore the gains of the amplifiers 301 to 306 cannot be controlled digitally by the level judgment and gain control unit 253 of the DSP 25:

In this case, the level judgment and gain control unit 253 adjusts the attenuation values of the variable attenuation units 2511 to 2516. Namely, the variable gain amplifiers 301 to 306 are designed in their gains so that the line output level of the required lowest limit is obtained when using the microphone having the lowest sensitivity. The level judgment and gain control unit 253 adjusts the attenuation values of the variable attenuation units 2511 to 2516.

Figure 26:
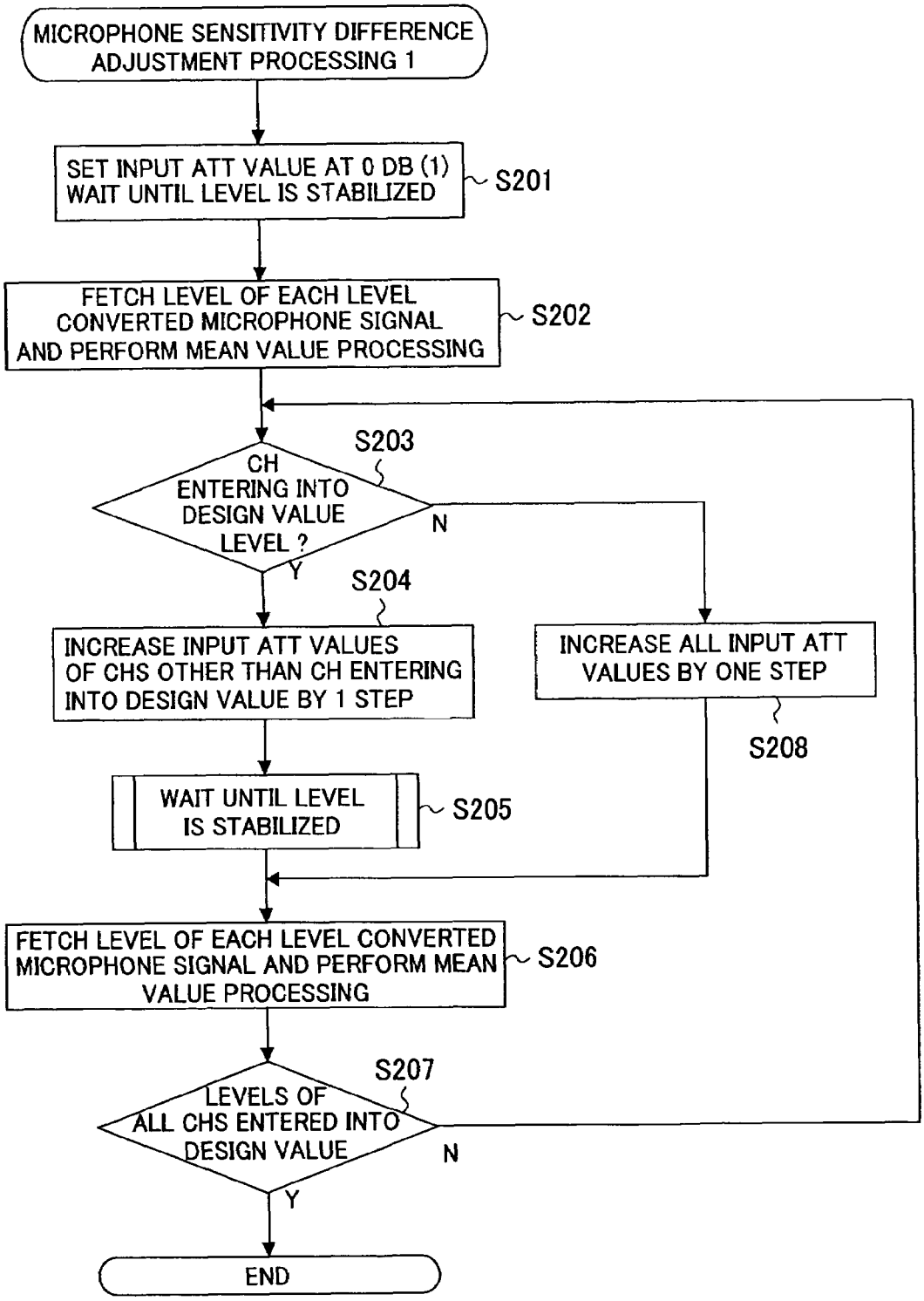
FIG. 26 is a flow chart showing a first processing method of the second embodiment of the present invention.

Below, a description will be given of the processing of the level judgment and gain control unit 253 by referring to FIG. 26.

Step S201: The attenuation values of the variable attenuation units 2511 to 2516 are set to 0 dB (1). Further, the stabilization of the level detection operation of the level detection unit 252 is awaited.

Step S202: The average level of the microphone signals converted in level at the level detection units 2521 to 2526 is measured.

Steps S203 to 207: The attenuation values of the variable attenuation units 2511 to 2516 are changed so that the channels become the design value levels of the sensitivity difference adjustment error by referring to the measured mean value. Further, by using the mean level of the microphone signals converted in level at the first to sixth level detection units 2521 to 2526 after changing the attenuation values of the variable attenuation units 2511 to 2516, the attenuation values of the variable attenuation units 2511 to 2516 are changed so that each channel repeatedly becomes the design value level of the sensitivity difference adjustment error. The adjustment precision of the sensitivity difference is determined by the precision of driving the level difference at this time.

By determining the adjustment range of the attenuation values in advance in this way, defects of the microphones can be detected.

Case 2: Case where the gains of the variable gain amplifiers 301 to 306 can be controlled digitally for each channel, and the control width is not more than the sensitivity difference adjustment error, for example, 0.5 dB.

Figure 27:
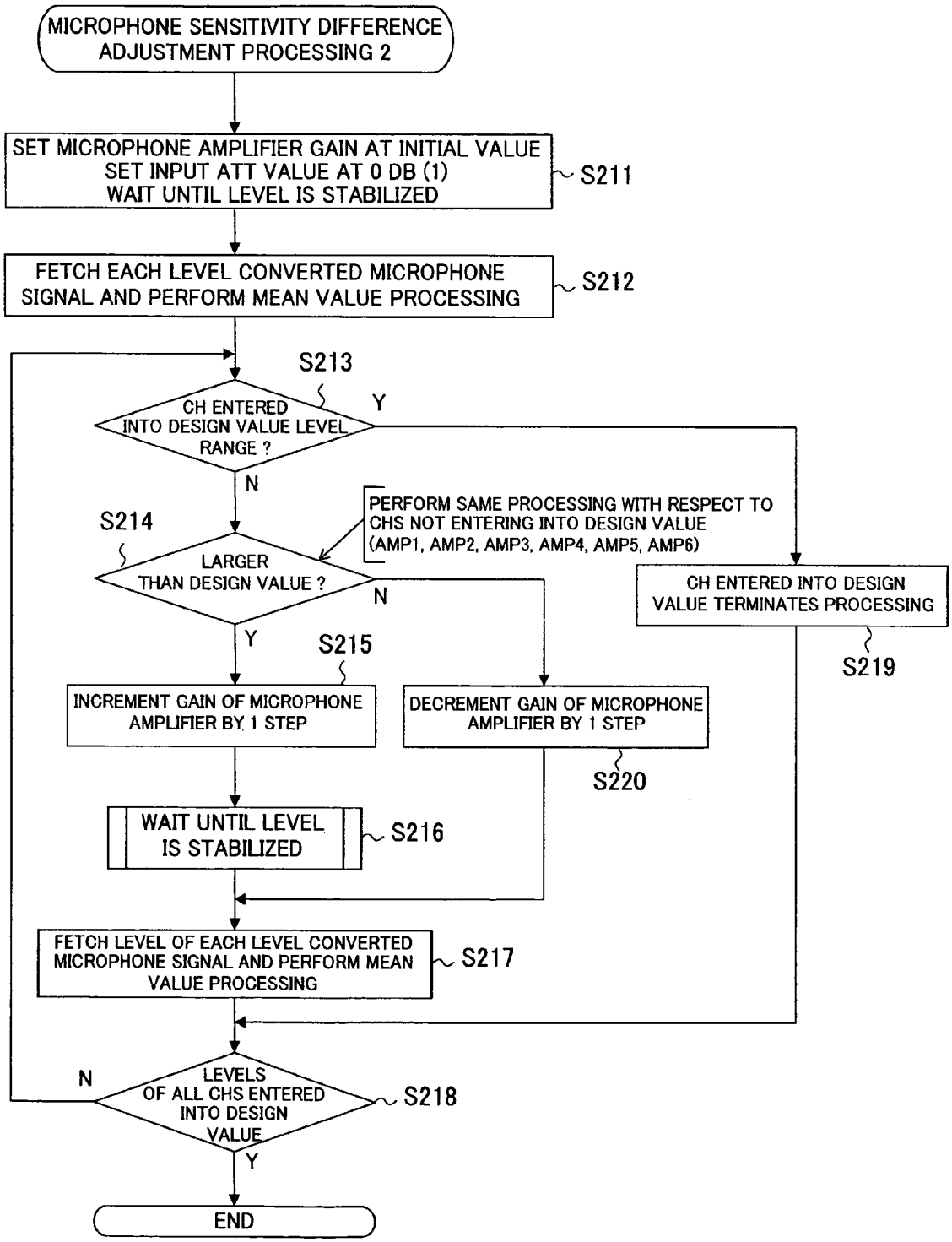
FIG. 27 is a flow chart showing a second processing method of the second embodiment of the present invention.

As illustrated in FIG. 27, the level judgment and gain control unit 253 performs the following processing for adjusting the gains of the variable gain amplifiers 301 to 306;

Step S211: The gains of the variable gain amplifiers 301 to 306 are set at initial values. Further, the attenuation values of the variable attenuation units 2511 to 2516 are set at 0 dB (1), and stabilization of the level detections at the level detection units 2521 to 2526 is awaited.

Step S212: The mean value of the microphones converted in level at the level detection units 2521 to 2526 is measured.

Steps S213 to 219: If there is a microphone having a channel with a measurement result within the value of ±0.5 dB which is the design value of the sensitivity difference adjustment error, the adjustment of the channel is terminated. If there is no such microphone, the gains of the variable gain amplifiers 301 to 306 are changed (adjusted) so as to be within the range of the design value of the sensitivity difference adjustment error. Further, by using the mean level of the microphone signals converted in level at the level detection units 2521 to 2526 after changing the gains of the variable gain amplifiers 301 to 306, the gains of the variable gain amplifiers 301 to 306 are changed so that each channel repeatedly gets the design value level of the sensitivity difference adjustment error. By determining the adjustment range of the gains of the variable gain amplifiers 301 to 306 in advance in this way, defects of the variable gain amplifiers 301 to 306 or the microphone can be detected.

Figure 28:
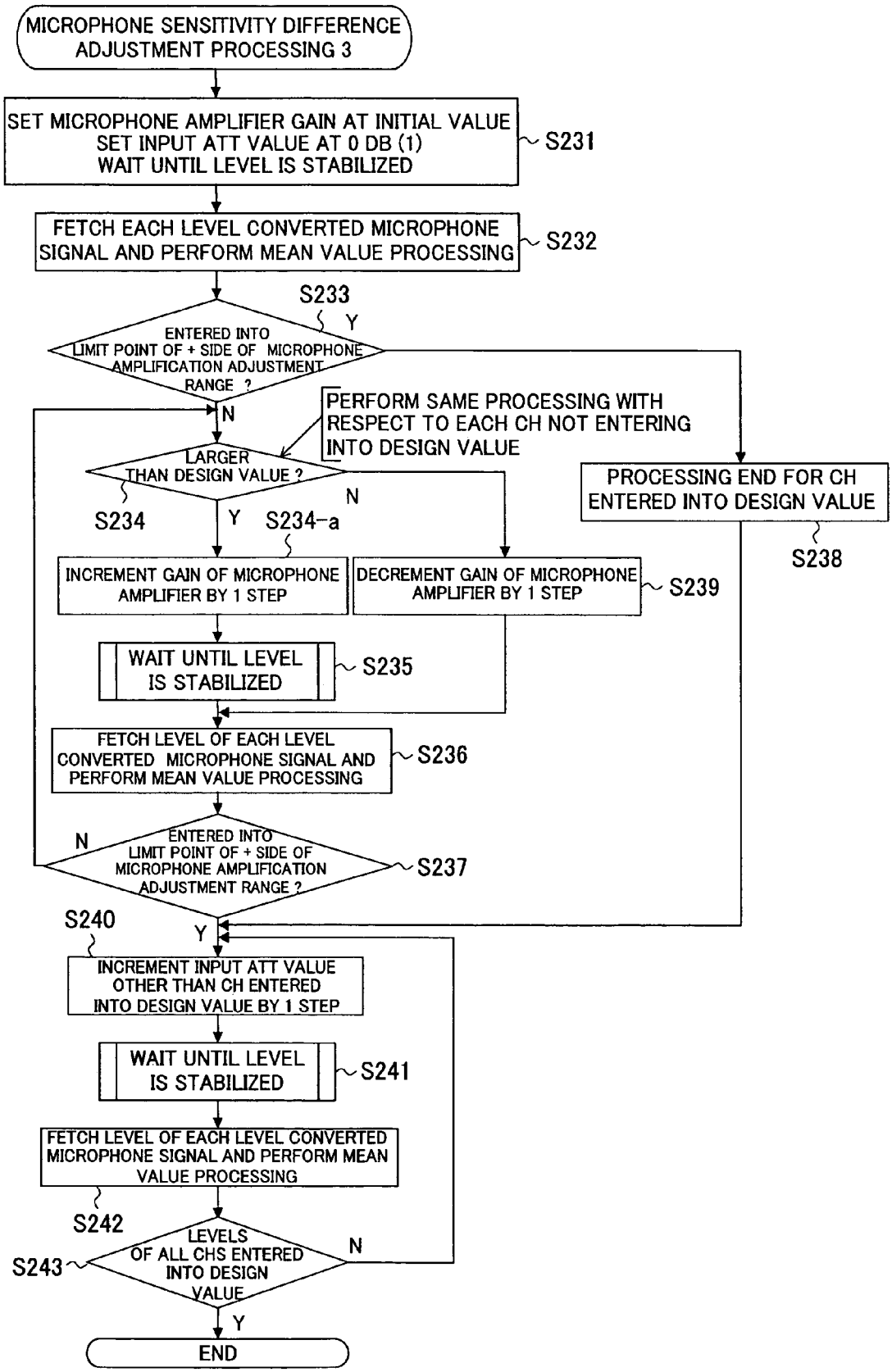
FIG. 28 is a flow chart showing a third processing method of the second embodiment of the present invention.

Case 3: Case where gains of variable gain amplifiers 301 to 306 can be controlled digitally for each channel, and the control width is for example 2 dB or more:

As illustrated in FIG. 28, the level judgment and gain control unit 253 first adjusts the gains of the variable gain amplifiers 301 to 306 (steps S231 to S237) and then adjusts the attenuation amounts of the variable attenuation units 2511 to 2516 (steps S238 to S241).

Steps S231 to S238: Basically, this is the same as the processing of Case 2 explained by referring to FIG. 27. The gains of the variable gain amplifiers 301 to 306 are adjusted.

Namely, at step S231, the gains of the variable gain amplifiers 301 to 306 are set to the initial values, the attenuation values of the variable attenuation units 2511 to 2516 are set at 0 dB (1), and the mean value of the microphones converted in level at the level detection units 2521 to 2526 is measured. If there is a microphone of a channel having a measurement result within the range of the value of ±0.5 dB of the design value of the sensitivity difference adjustment error, the adjustment of the channel is terminated. If there is no such microphone, the gains of the variable gain amplifiers 301 to 306 are set so that the mean level is within the range of the plus values from the design value of the sensitivity difference adjustment error.

The control width of the gain adjustment of the variable gain amplifiers 301 to 306 is 2 dB in Case 3 and not the 0.5 dB control width as in Case 2. Therefore, after that, the attenuation amounts are adjusted at the variable attenuation units 2511 to 2516 by the following processing.

Steps S240 to S243: The attenuation amounts of the variable attenuation units 2511 to 2516 of the microphone signal of the channel not within the design value of the sensitivity difference adjustment error are changed. After waiting until the levels in the level detection units 2521 to 2526 become stable, the level of the microphone signal having a stabilized level is fetched and subjected to the mean value processing. Repeated processing is carried out until the value becomes within the range of the design value of the sensitivity difference adjustment error. The attenuation values of the variable attenuation units 2511 to 2516 are set so that the mean level value of the microphone signal channels becomes within the range of ±0.5 dB of the design value of the sensitivity difference adjustment error. By determining the adjustment range of gains of the variable gain amplifiers 301 to 306 in advance in this way, defects of the variable gain amplifiers 301 to 306 or microphone can be detected.

Figure 29:
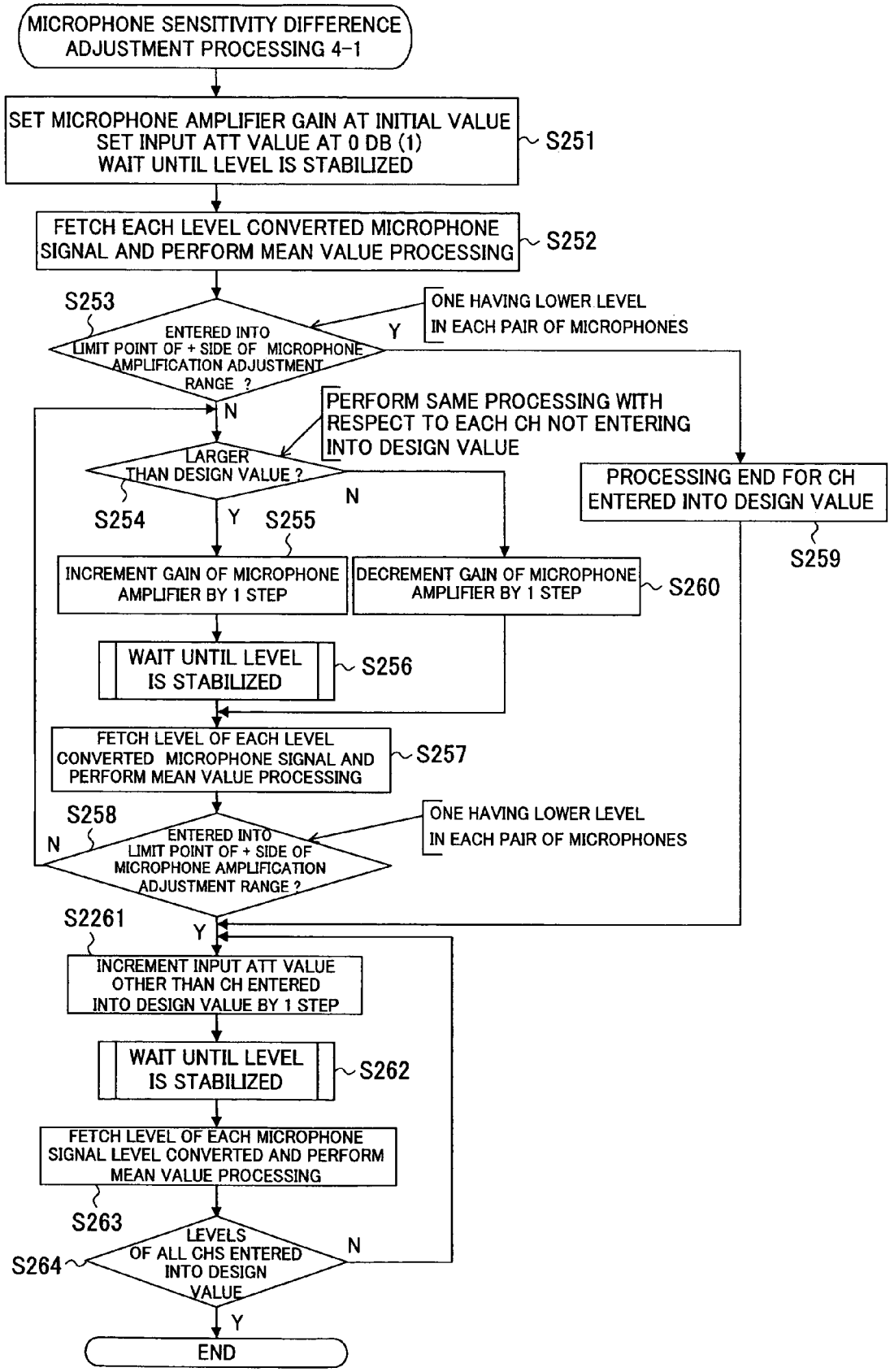
FIG. 29 is a flow chart showing the first form of a fourth processing method of the second embodiment of the present invention.
Figure 30:
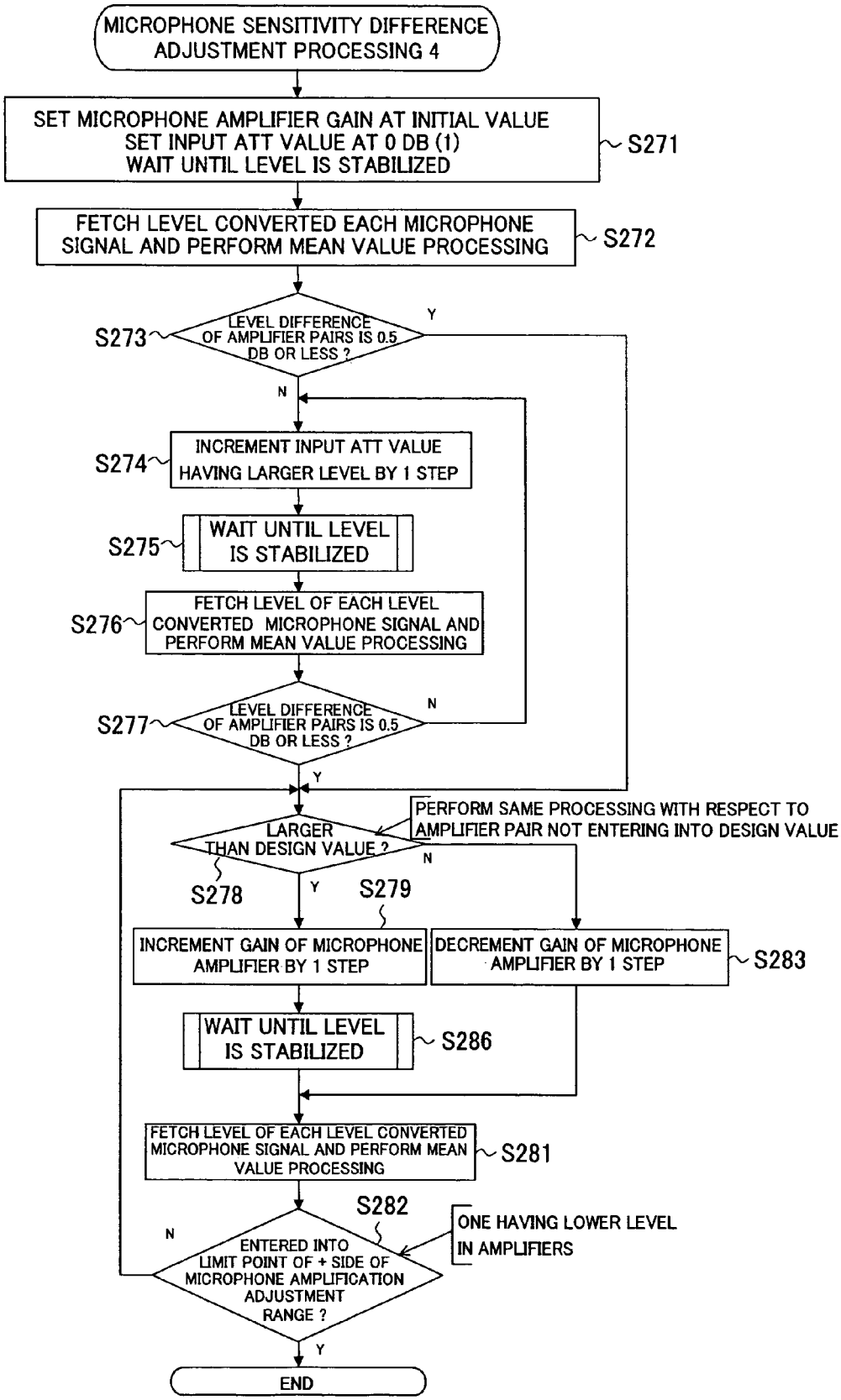
FIG. 30 is a flow chart showing a second form of the fourth processing method of the second embodiment of the present invention.

Case 4: Case where the variable gain amplifiers 301 to 306 are built in the A/D converters 271 to 273, the gains of the variable gain amplifiers 301 to 306 can be simultaneously controlled for only two channels digitally in actuality, and the control width is not more than the sensitivity difference adjustment error, for example 0.5 dB:

As illustrated in FIG. 29 and FIG. 30, the level judgment and gain control unit 253 performs the following processing.

Steps S251, S271: The gains of the variable gain amplifiers 301 to 306 are set at the initial values, attenuation values of the variable attenuation units 2511 to 2516 are set at 0 dB (1), and stabilization of the level detections at the level detection units 2521 to 2526 is awaited.

Steps S252, S272: The mean value processing of the level detections detected at the level detection units 2521 to 2526 is carried out.

Below, the following two adjustment methods are employed as illustrated in FIG. 29 and FIG. 30.

FIG. 29 shows the method adjusting the gain of the variable gain amplifiers 301 to 306 earlier and adjusting the attenuation values of the variable attenuation units 2511 to 2516 later (Case 4-1), while FIG. 30 shows the method for adjusting the attenuation values of the variable attenuation units 2511 to 2516 earlier and adjusting the gains of the variable gain amplifiers 301 to 306 later reverse to the method illustrated in FIG. 29 (Case 4-2).

Case 4-1: As illustrated at steps S253 to S259 of FIG. 29, the gains of the variable gain amplifiers 301 to 306 are adjusted so that the signal levels in the group of the variable gain amplifiers 301 to 306 where the gains can be set become the low signal level of the channels and so that the signal levels of the other channels become the low signal level of the channels ±0.5 dB. Then, as illustrated at steps S261 to S264, the attenuation values of the variable attenuation units 2511 to 2516 are adjusted so that the signal levels having a high level become a range of 10.5 dB of the design value of the sensitivity difference adjustment error.

Case 4-2: As illustrated at steps S273 to S277 of FIG. 30, the gains of the variable gain amplifiers 301 to 306 are adjusted so that the mean level value of the microphone signal channels becomes a range of ±0.5 dB of the design value. Then, as illustrated at steps S278 to S282, the gains of the variable gain amplifiers 301 to 306 are adjusted so that the signal levels in the group of the variable gain amplifiers 301 to 306 where the gains can be set becomes the range of the low signal level of the channels and so that the signal levels of the other channels become the range of the low signal level of the channels ±0.5 dB.

By determining the adjustment ranges of the attenuation values of the variable attenuation units 2511 to 2516 and gains of the variable gain amplifiers 301 to 306 in advance in this way, defects of the variable gain amplifiers 301 to 306 or microphones can be detected.

Figure 31:
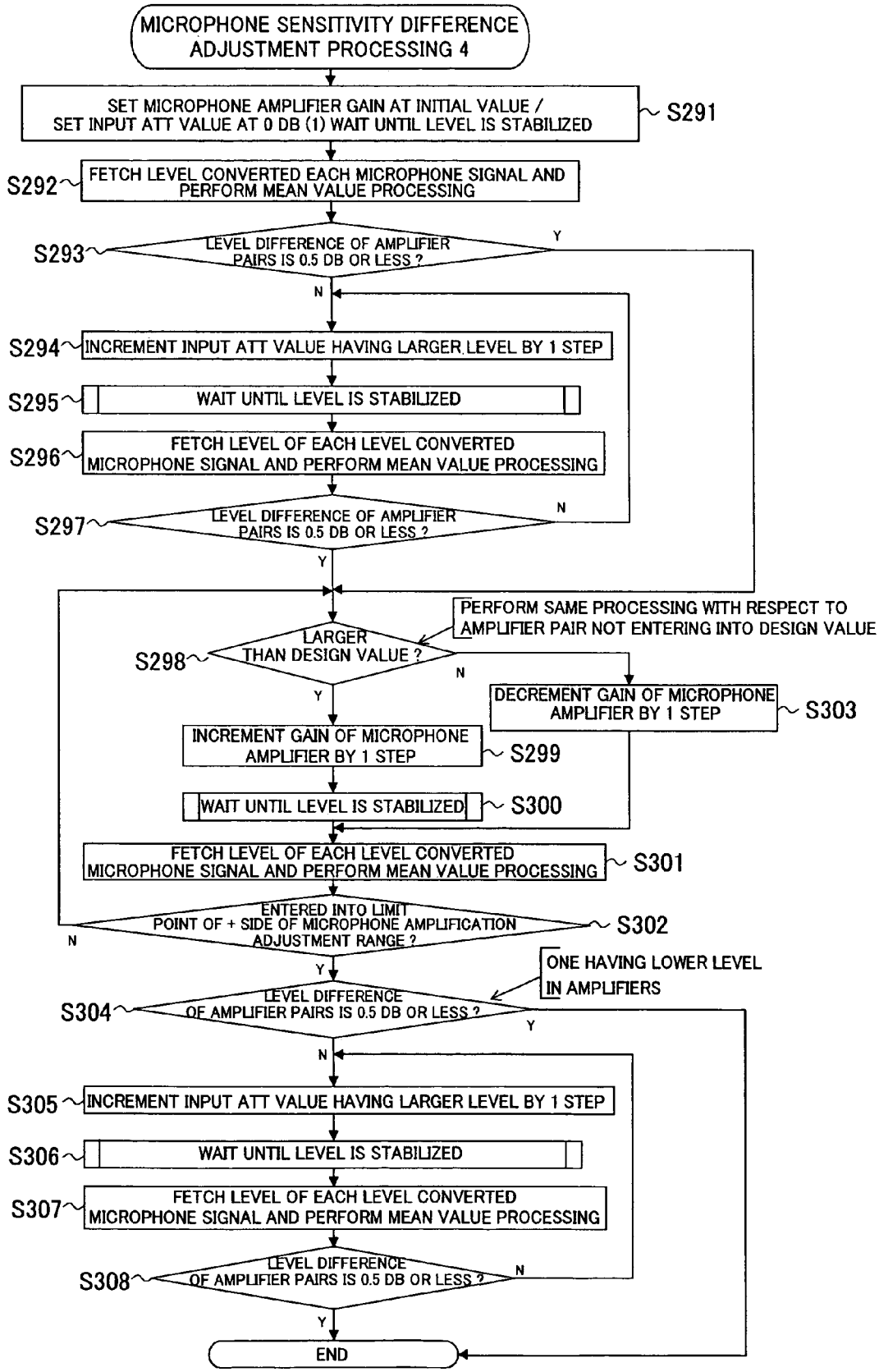
FIG. 31 is a flow chart showing a fifth processing method of the second embodiment of the present invention.

Case 5: Case where the variable gain amplifiers 301 to 306 are built in the A/D converters 271 to 273, the gains of the amplifiers 301 to 306 can be simultaneously controlled digitally only for only two channels in actuality, and the control width is for example 2 dB or less:

As illustrated in FIG. 31, the level judgment and gain control unit 253 first adjusts the attenuation amounts of the variable attenuation units 2511 to 2516 (S293 to S297), then adjusts the gains of the variable gain amplifiers 301 to 306 (S298 to S303), and further adjusts the attenuation amounts of the variable attenuation units 2511 to 2516 (S304 to S308). Below, a detailed description will be given.

Step S291: The gains of the variable gain amplifiers 301 to 306 are set at the initial values, the attenuation values of the variable attenuation units 2511 to 2516 are set at 0 dB (1), and stabilization of the level detections of the level detection units 2521 to 2526 is awaited.

Step S292: The mean value processing of microphone signals converted in level at the level detection units 2521 to 2526 is carried out.

Steps S293 to S297: The attenuation values of the variable attenuation units 2511 to 2516 are adjusted so as to match the other signal levels with the channel signal level of the lowest level of the microphone channels in the group of the variable gain amplifiers 301 to 306 where the gains can be set.

Steps S298 to S303: The gains of the variable gain amplifiers 301 to 306 are adjusted so that the mean level value of the microphone signal channels becomes the range of ±1 dB of the design value of the sensitivity difference adjustment error.

Steps S304 to S308: The attenuation values of the variable attenuation units 2511 to 2516 are adjusted so that the microphone signal level becomes ±0.5 dB of the sensitivity difference adjustment error again.

By determining the adjustment ranges of the attenuation values and the gains of the variable gain amplifiers 301 to 306 in advance in this way, defects of the circuits or microphones can be detected.

According to the second embodiment, the sensitivity difference of a facing pair of microphones connected to the amplifiers of the microphones in the fixed manner is automatically adjusted, a sensitivity difference of a plurality of microphones arranged at equal distances from the receiving and reproduction speaker 16 is automatically corrected, and the gains of the amplifiers of the transmitting microphones can be automatically adjusted so that the acoustic couplings between the receiving and reproduction speaker 16 and the microphones MC1 to MC6 become equal.

In working the present embodiment, no special device is needed. Only the integral microphone and speaker configuration type communication apparatus need be used. Accordingly, in the state where the integral microphone and speaker configuration type communication apparatus is arranged, the above adjustment can be carried out.

While the invention has been described with reference to specific embodiments chosen for purpose of illustration, it should be apparent that numerous modifications could be made thereto by those skilled in the art without departing from the basic concept and scope of the invention.

The invention claimed is:

1. A communication apparatus comprising:

a speaker, at least one pair of microphones having directivity and arranged on a straight line straddling a center axis of the speaker arranged around the center axis of said speaker radially at equal angles and at equal distances from the speaker, an amplifying means for independently amplifying sound picked up by the microphones and able to adjust gain, a level detecting means for calculating an absolute value of a difference of signals of a pair of microphones, among output signals of the amplifying means, and holding a peak value of the calculated absolute values, a test signal generating means outputting a pink noise signal to the speaker, and a level judging/gain controlling means adjusting the gain of the amplifying means so that the difference of signals of the pair of microphones detected by the level detecting means becomes within a predetermined sensitivity difference adjustment error when the microphones detect the speaker outputting a sound in accordance with the pink noise.

2. A communication apparatus as set forth in claim 1, wherein:

the gain of said amplifying means is a gain automatically adjustable digitally by said level judging/gain controlling means, said level detecting means and said level judging/gain controlling means are integrally configured by a digital signal processor, and said level judging/gain controlling means digitally changes the gain of said amplifying means.

3. A communication apparatus comprising:

a speaker, at least one pair of microphones having directivity and arranged on a straight line straddling a center axis of the speaker arranged around the center axis of said speaker radially at equal angles and at equal distances from the speaker, an amplifying means for amplifying sound picked up by the microphones, an attenuating means for independently attenuating sound signals amplified by the amplifying means, a level detecting means for calculating an absolute value of difference of signals of a pair of microphones, among output signals of the attenuating means, and holding a peak value of the calculated absolute values, a test signal generating means outputting a pink noise signal to the speaker, and a level judging/gain controlling means adjusting an attenuation amount of the attenuating means so that the difference of signals of the pair of microphones detected by the level detecting means becomes within a predetermined sensitivity difference adjustment error when the microphones detect the speaker outputting a sound in accordance with the pink noise.

4. A communication apparatus as set forth in claim 3, wherein:

the attenuating means, the level detecting means, and the level judging/gain controlling means are integrally configured by a digital signal processor, and the attenuation amount of the attenuating means is set digitally by the level judging/gain controlling means.

5. A communication apparatus comprising:

a speaker, at least one pair of microphones having directivity and arranged on a straight line straddling a center axis of the speaker arranged around the center axis of said speaker radially at equal angles and at equal distances from the speaker, an amplifying means for independently amplifying sounds picked up by the microphones and able to adjust gain, an attenuating means for independently attenuating sound signals amplified by the amplifying means, a level detecting means for calculating an absolute value of a difference of signals of a pair of microphones, among output signals of the attenuating means, and holding a peak value of the calculated absolute values, a test signal generating means outputting a pink noise signal to the speaker, and a level judging/gain controlling means adjusting the gain of the amplifying means and/or the attenuation amount of the attenuating means so that the difference of signals of the pair of microphones detected by the level detecting means becomes within a predetermined sensitivity difference adjustment error when the microphones detect the speaker outputting a sound in accordance with the pink noise.

6. A communication apparatus as set forth in claim 5, wherein:

the attenuating means, the level detecting means, and the level judging/gain controlling means are integrally configured by a digital signal processor, and the attenuation amount of the attenuating means is set digitally by the level judging/gain controlling means.

7. A communication apparatus as set forth in claim 6, wherein when the gain of the amplifying means cannot be adjusted digitally, the level judging/gain controlling means adjusts the attenuation amount of the attenuating means.

8. A communication apparatus as set forth in claim 6, wherein when the gain of the amplifying means can be adjusted digitally and a control width thereof is smaller than the sensitivity difference adjustment error, the level judging/gain controlling means adjusts the gain of the amplifying means.

9. A communication apparatus as set forth in claim 6, wherein when the gain of the amplifying means can be adjusted digitally and the control width thereof is larger than the sensitivity difference adjustment error, the level judging/gain controlling means adjusts the gain of the amplifying means in a possible range and then adjusts the attenuation amount of the attenuating means.

10. A communication apparatus as set forth in claim 6, wherein when the gain of the amplifying means can be adjusted digitally together with the detection signal of a pair of microphones and the control width thereof is smaller than the sensitivity difference adjustment error, the level judging/gain controlling means adjusts the gain of the amplifying means for the detection signals of a pair of microphones in the possible range and then independently adjusts the attenuation amount of the attenuating means.

11. A communication apparatus as set forth in claim 6, wherein when the gain of the amplifying means can be adjusted digitally together with the detection signal of a pair of microphones and the control width thereof is smaller than the sensitivity difference adjustment error, the level judging/gain controlling means independently adjusts the attenuation amount of the attenuating means and then adjusts the gain of the amplifying means for the detection signals of a pair of microphones in the possible range.

12. A communication apparatus as set forth in claim 6, wherein when the gain of the amplifying means can be adjusted digitally together with the detection signal of a pair of microphones and the control width thereof is larger than the sensitivity difference adjustment error, the level judging/gain controlling means adjusts a higher attenuation amount of the attenuating means between detection signals of the microphones and then adjusts the gain of the amplifying means for the detection signals of a pair of microphones, and further adjusts the higher attenuation amount of the attenuating means between the detection signals of the microphones.

* * * * *